US007090025B2

(12) United States Patent
Haugen et al.

(10) Patent No.: US 7,090,025 B2
(45) Date of Patent: Aug. 15, 2006

(54) METHODS AND APPARATUS FOR REFORMING AND EXPANDING TUBULARS IN A WELLBORE

(75) Inventors: David Haugen, League City, TX (US); Simon John Harrall, Invenurie (GB); Paul David Metcalfe, Peterculter (GB); Frederick T. Tilton, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 210 days.

(21) Appl. No.: 10/725,340

(22) Filed: Dec. 1, 2003

(65) Prior Publication Data

US 2004/0159446 A1 Aug. 19, 2004

Related U.S. Application Data

(63) Continuation-in-part of application No. 10/032,998, filed on Oct. 25, 2001, now Pat. No. 6,708,767.

(60) Provisional application No. 60/467,503, filed on May 2, 2003.

(30) Foreign Application Priority Data

Oct. 25, 2000 (GB) ..... 0026063

(51) Int. Cl.
*E21B 23/02* (2006.01)

(52) U.S. Cl. ..... 166/384; 166/207

(58) Field of Classification Search ..... 166/382, 166/207, 217, 384, 385, 277, 206, 216
See application file for complete search history.

(56) References Cited

U.S. PATENT DOCUMENTS 761,518 A 5/1904 Lykken
1,324,303 A 12/1919 Carmichael
1,545,039 A 7/1925 Deavers
1,561,418 A 11/1925 Duda
1,569,729 A 1/1926 Duda
1,597,212 A 8/1926 Spengler
1,930,825 A 10/1933 Raymond
2,383,214 A 8/1945 Prout
2,499,630 A 3/1950 Clark (Continued)

FOREIGN PATENT DOCUMENTS

EP 0 961 007 12/1999

(Continued)

OTHER PUBLICATIONS

Bourgoyne Jr. et al "Applied Drilling Engineering" Society of Petroleum Engineers, 1986, p. 428.*

(Continued)

*Primary Examiner*—Frank Tsay
(74) *Attorney, Agent, or Firm*—Patterson & Sheridan, L.L.P.

(57) ABSTRACT

The present invention provides a method and apparatus for deforming a tubular body, running the tubular body through a restriction in a wellbore, reforming the tubular body, and expanding at least a portion of the tubular body past its elastic limit. In one aspect, the present invention provides a method for forming a substantially monobore well involving deforming a tubular body, running the tubular body below a restricted inner diameter portion, reforming the tubular body, and expanding at least a portion of the tubular body past its elastic limit. The restricted inner diameter portion may comprise a casing string previously disposed within the wellbore or a casing patch. The at least the portion of the tubular body expanded past its elastic limit may be a lower portion of the tubular body. Subsequent tubular bodies may be reformed and expanded below previous tubular bodies.

41 Claims, 13 Drawing Sheets

U.S. PATENT DOCUMENTS

| | | | | |
|---|---|---|---|---|
| 2,627,891 | A | 2/1953 | Clark | |
| 2,663,073 | A | 12/1953 | Bieber et al. | |
| 2,898,971 | A | 8/1959 | Hempel | |
| 3,087,546 | A | 4/1963 | Woolley | |
| 3,195,646 | A | 7/1965 | Brown | |
| 3,203,483 | A | 8/1965 | Vincent | |
| 3,467,180 | A | 9/1969 | Pensotti | |
| 3,545,543 | A | 12/1970 | Johnson et al. | |
| 3,818,734 | A | 6/1974 | Bateman | |
| 3,911,707 | A | 10/1975 | Minakov et al. | |
| 4,069,573 | A | 1/1978 | Rogers, Jr. et al. | |
| 4,127,168 | A | 11/1978 | Hanson et al. | |
| 4,159,564 | A | 7/1979 | Cooper, Jr. | |
| 4,288,082 | A | 9/1981 | Setterberg, Jr. | |
| 4,324,407 | A | 4/1982 | Upham et al. | |
| 4,429,620 | A | 2/1984 | Burkhardt et al. | |
| 4,531,581 | A | 7/1985 | Pringle et al. | |
| 4,588,030 | A | 5/1986 | Blizzard | |
| 4,697,640 | A | 10/1987 | Szarka | |
| 4,848,469 | A | 7/1989 | Baugh et al. | |
| 4,976,322 | A | 12/1990 | Abdrakhmanov et al. | |
| 5,014,779 | A * | 5/1991 | Meling et al. | 166/55.7 |
| 5,031,699 | A | 7/1991 | Artynov et al. | |
| 5,083,608 | A | 1/1992 | Abdrakhmanov et al. | |
| 5,271,472 | A | 12/1993 | Leturno | |
| 5,409,059 | A | 4/1995 | McHardy | |
| 5,435,400 | A | 7/1995 | Smith | |
| 5,472,057 | A | 12/1995 | Winfree | |
| 5,560,426 | A | 10/1996 | Trahan et al. | |
| 5,685,369 | A | 11/1997 | Ellis et al. | |
| 5,785,120 | A | 7/1998 | Smalley et al. | |
| 5,794,702 | A * | 8/1998 | Nobileau | 166/380 |
| 5,901,787 | A | 5/1999 | Boyle | |
| 5,957,195 | A | 9/1999 | Bailey et al. | |
| 5,979,560 | A * | 11/1999 | Nobileau | 166/381 |
| 6,021,850 | A | 2/2000 | Wood et al. | |
| 6,098,717 | A | 8/2000 | Bailey et al. | |
| 6,138,761 | A * | 10/2000 | Freeman et al. | 166/313 |
| 6,142,230 | A | 11/2000 | Smalley et al. | |
| 6,325,148 | B1 | 12/2001 | Trahan et al. | |
| 6,425,444 | B1 | 7/2002 | Metcalfe et al. | |
| 6,446,323 | B1 | 9/2002 | Metcalfe et al. | |
| 6,457,532 | B1 | 10/2002 | Simpson | |
| 6,457,533 | B1 | 10/2002 | Metcalfe | |
| 6,527,049 | B1 | 3/2003 | Metcalfe et al. | |
| 6,543,552 | B1 | 4/2003 | Metcalfe et al. | |
| 6,543,816 | B1 | 4/2003 | Noel | |
| 6,629,568 | B1 | 10/2003 | Post et al. | |
| 6,688,397 | B1 | 2/2004 | McClurkin et al. | |
| 6,702,029 | B1 | 3/2004 | Metcalfe et al. | |
| 6,708,767 | B1 | 3/2004 | Harrall et al. | |
| 6,712,401 | B1 | 3/2004 | Coulon et al. | |
| 2002/0108756 | A1 | 8/2002 | Harrall et al. | |
| 2003/0150608 | A1 | 8/2003 | Smith et al. | |
| 2003/0168222 | A1 | 9/2003 | Maguire et al. | |
| 2003/0230410 | A1 | 12/2003 | Underhill | |
| 2004/0020659 | A1 | 2/2004 | Hall et al. | |
| 2004/0020660 | A1 | 2/2004 | Johnson et al. | |
| 2004/0159446 | A1 | 8/2004 | Haugen et al. | |
| 2004/0177953 | A1 | 9/2004 | Wubben | |
| 2005/0045342 | A1 | 3/2005 | Luke et al. | |

FOREIGN PATENT DOCUMENTS

| | | |
|---|---|---|
| GB | 1 485 099 | 9/1977 |
| GB | 2 086 282 | 5/1982 |
| GB | 2 320 734 | 7/1998 |
| GB | 2 383 361 | 6/2003 |
| GB | 2 388 130 | 11/2003 |
| GB | 2 388 137 | 11/2003 |
| GB | 2 401 131 | 11/2004 |
| RU | 2 083 798 | 10/1997 |
| RU | 2 187 619 | 8/2002 |
| SU | 1 745 873 | 7/1992 |
| WO | WO 84/00120 | 1/1984 |
| WO | WO 93/24728 | 12/1993 |
| WO | WO 99/18328 | 4/1999 |
| WO | WO 99/23354 | 5/1999 |
| WO | WO 00/31375 | 6/2000 |
| WO | WO 00/37766 | 6/2000 |
| WO | WO 00/37771 | 6/2000 |
| WO | WO 01/38693 | 5/2001 |
| WO | WO 05/003511 | 1/2005 |
| WO | WO 02/059456 | 8/2005 |

OTHER PUBLICATIONS

U.K. Search Report, Application No. GB 0409942.0, dated Aug. 24, 2004.

Gabdrashit S. Abdrakhmanov, Isolation Profile Liner Helps Stabilize Problem Well Bores, Technology.

Takhautdinov, et al., Expandable-Profile Liners in Well Construction-1, Oil & Gas Journal, Aug. 12, 2002.

* cited by examiner

METHODS AND APPARATUS FOR REFORMING AND EXPANDING TUBULARS IN A WELLBORE

CROSS-REFERENCE TO RELATED APPLICATIONS

This application is a continuation-in part of U.S. patent application Ser. No. 10/032,998, filed on Oct. 25, 2001, now U.S. Pat. No. 6,708,767 which is herein incorporated by reference in its entirety. U.S. patent application Ser. No. 10/032,998 claims benefit of Great Britain Application Serial Number 0026063.8, filed on Oct. 25, 2000, which is herein incorporated by reference in its entirety.

This application further claims benefit of U.S. Provisional Application No. 60/467,503, filed on May 2, 2003, which is herein incorporated by reference in its entirety.

BACKGROUND OF THE INVENTION

1. Field of the Invention

The present invention generally relates to methods and apparatus for expanding a tubular body in a wellbore. More specifically, the invention relates to methods and apparatus for forming a cased wellbore having an inner diameter that does not decrease with increasing depth within a formation.

2. Description of the Related Art

In well completion operations, a wellbore is formed to access hydrocarbon-bearing formations by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annular area is thus formed between the string of casing and the formation. The casing string is temporarily hung from the surface of the well. A cementing operation is then conducted in order to fill the annular area with cement. Using apparatus known in the art, the casing string is cemented into the wellbore by circulating cement into the annular area defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with a drill bit on a drill string. The drill string is removed. A first string of casing or conductor pipe is then run into the wellbore and set in the drilled out portion of the wellbore, and cement is circulated into the annulus behind the casing string. Next, the well is drilled to a second designated depth, and a second string of casing, or liner, is run into the drilled out portion of the wellbore. The second string is set at a depth such that the upper portion of the second string of casing overlaps the lower portion of the first string of casing. The second liner string is then fixed, or "hung" off of the existing casing by the use of slips which utilize slip members and cones to wedgingly fix the new string of liner in the wellbore. The second casing string is then cemented. This process is typically repeated with additional casing strings until the well has been drilled to total depth. As more casing strings are set in the wellbore, the casing strings become progressively smaller in diameter in order to fit within the previous casing string. In this manner, wells are typically formed with two or more strings of casing of an ever-decreasing diameter.

Decreasing the diameter of the wellbore produces undesirable consequences. Progressively decreasing the diameter of the casing strings with increasing depth within the wellbore limits the size of wellbore tools which are capable of being run into the wellbore. Furthermore, restricting the inner diameter of the casing strings limits the volume of hydrocarbon production which may flow to the surface from the formation.

Recently, methods and apparatus for expanding the diameter of casing strings within a wellbore have become feasible. As a result of expandable technology, the inner diameter of the cased wellbore does not decrease as sharply upon setting more casing strings within the wellbore as the inner diameter of the cased wellbore decreases when not using expandable technology. When using expandable casing strings to line a wellbore, the well is drilled to a first designated depth with a drill bit on a drill string, then the drill string is removed. A first string of casing is set in the drilled out portion of the wellbore, and cement is circulated into the annulus behind the casing string. Next, the well is drilled to a second designated depth, and a second string of casing is run into the drilled out portion of the wellbore at a depth such that the upper portion of the second string of casing overlaps the lower portion of the first string of casing. The second casing string is then expanded into contact with the existing first string of casing with an expander tool. The second casing string is then cemented. This process is typically repeated with additional casing strings until the well has been drilled to total depth.

An exemplary expander tool utilized to expand the second casing string into the first casing string is fluid powered and run into the wellbore on a working string. The hydraulic expander tool includes radially expandable members which, through fluid pressure, are urged outward radially from the body of the expander tool and into contact with the second casing string therearound. As sufficient pressure is generated on a piston surface behind these expansion members, the second casing string being acted upon by the expansion tool is expanded past its point of elastic deformation. In this manner, the inner and outer diameter of the expandable tubular is increased in the wellbore. By rotating the expander tool in the wellbore and/or moving the expander tool axially in the wellbore with the expansion member actuated, a tubular can be expanded into plastic deformation along a predetermined length in a wellbore.

The method of expanding the second casing string into the first casing string involves expansion of the second casing string past its elastic limit once located at the desired depth within the wellbore. Because a casing string is typically only capable of expansion to about 22–25% past its elastic limit, the amount of expansion of the casing string is limited when using this method. Expansion past about 22–25% of its original diameter may cause the casing string to fracture due to stress.

The advantage gained with using expander tools to expand expandable casing strings is the decreased annular space between the overlapping casing strings. Because the subsequent casing string is expanded into contact with the previous string of casing, the decrease in diameter of the wellbore is essentially the thickness of the subsequent casing string. However, even when using expandable technology, casing strings must still become progressively smaller in diameter in order to fit within the previous casing string.

Currently, monobore wells are being investigated to further limit the decrease in the inner diameter of the wellbore with increasing depth. Monobore wells would theoretically result when the wellbore is approximately the same diameter along its length, causing the path for fluid between the surface and the wellbore to remain consistent along the length of the wellbore and regardless of the depth of the well. With a monobore well, tools could be more easily run into the wellbore because the size of the tools which may travel through the wellbore would not be limited to the constricted inner diameter of casing strings of decreasing inner diameters. Theoretically, in the formation of a monobore well, a first casing string could be inserted into the wellbore. Thereafter, a second casing string of a smaller diameter than the first casing string could be inserted into the wellbore and expanded to approximately the same inner diameter as the first casing string.

Certain problems have arisen during the investigation of monobore wells. One problem relates to the expansion of the smaller casing string into the larger casing string to form a sealed connection therebetween where the first and second casing strings overlap. Forming a monobore well would involve first running the smaller casing string through the restricted inner diameter of the wellbore produced by the larger casing string, then expanding the smaller casing string to an inner diameter at least as large the smallest inner diameter of the larger casing string. This portion of the expansion of the smaller casing string likely would increase the inner diameter of the smaller casing string by the limit of 22–25%. To insert an even smaller casing string inside the smaller casing string to form a monobore well, the inner diameter of a lower portion of the smaller casing string would have to be enlarged to receive the even smaller casing string. In this way, expansion of the casing string to over 25% of its original diameter would be necessary, but not currently possible. Merely expanding the casing string past its elastic limit after passing the restricted inner diameter portion may not allow the casing string to expand to a large enough inner diameter to form a substantially monobore well, as the percentage which the casing string may expand past its elastic limit is limited by structural constraints of the casing string. Attempts to expand the casing string further than about 22–25% past its elastic limit may cause the casing string to fracture or may simply be impossible.

Another type of expansion is currently performed in the context of casing patches. A casing patch is a tubular body which is expanded into contact with the wellbore or casing within the wellbore to patch leaking paths existing in the wellbore or cased wellbore. To patch the leaking path within the casing or wellbore, a casing patch is often deformed so that the casing patch possesses a smaller inner diameter than the inner diameter of the existing casing or wellbore, then the casing patch is reformed to a larger inner diameter when the casing patch is located at the desired location for reformation of the casing patch. The reforming process is often performed by an expander cone. This method often leaves stress lines in the reformed casing patch where the corrugations originally existed, weakening the casing patch at the stress lines so that the casing patch is susceptible to leaking wellbore fluids into the casing patch due to the pressure exerted by wellbore fluids.

Utilizing the current methods of expanding a casing string or reforming a casing patch, the problems described above are evident when a casing string or casing patch must run through a restriction in the inner diameter of the wellbore, such as a restriction formed by a packer or a previously installed casing patch, and then expand to an inner diameter at least as large as the restriction once the casing string or casing patch is lowered below the restriction. When using a casing patch, merely reforming the casing patch may leave stress lines in the casing patch which may allow fluid leakage therethrough. When using a casing string, merely expanding the casing string past its elastic limit by 22–25% may not allow enough expansion to increase the inner diameter of the casing string to at least the inner diameter of the restriction.

There is, therefore, a need for a method for enlarging the inner diameter of a casing string or other tubular body by more than current methods allow without compromising the structural integrity of the casing string or tubular body. There is a further need for a method for expanding the inner diameter of a casing string or tubular body by a larger percentage than the percentage expansion allowed past the elastic limit after running the casing string or tubular body through a restricted inner diameter portion of the wellbore. There is yet a further need for a method of expanding a lower portion of the inner diameter of a casing string or tubular body further than the remaining portions of the casing string or tubular body without compromising the structural integrity of the lower portion of the casing string or tubular body.

SUMMARY OF THE INVENTION

The present invention generally includes a method of expanding at least a portion of a tubular body within a wellbore comprising running a deformed tubular body into the wellbore, reforming the tubular body, and expanding at least the portion of the tubular body. The deformed tubular body may include corrugations inflicted upon the tubular body before insertion of the tubular body into the wellbore. Expanding the tubular body may comprise expanding the tubular body past its elastic limit.

In one aspect, a method of forming a substantially monobore well is disclosed, comprising running a deformed first casing string into a wellbore, reforming the first casing string, and expanding a lower portion of the first casing string past its elastic limit. The method may further comprise running a second deformed casing string into the wellbore to a depth at which the lower portion of the first casing string overlaps an upper portion of the second casing string, and reforming the second casing string. The lower portion of the second casing string may then be expanded past its elastic limit.

In yet another aspect, the present invention includes a method of forming a cased wellbore, comprising deforming a tubular body so that at least a portion of the deformed tubular body has a smaller inner diameter than an inner diameter of the tubular body, running the deformed tubular body into a wellbore through a restricted inner diameter portion, locating the deformed tubular body below the restricted inner diameter portion, reforming the tubular body, and expanding at least a portion of the tubular body past its elastic limit.

The present invention advantageously provides a method for enlarging the inner diameter of a casing string by more than about 22–25% without compromising the structural integrity of the casing string. Further, the present invention provides a method for expanding the inner diameter of a casing string further than the allowed elastic limit after running the casing string through a restricted inner diameter portion of the wellbore. The present invention also allows a method of expanding a lower portion of the inner diameter of a casing string further than the remaining portions of the casing string without compromising the structural integrity of the lower portion of the casing string.

BRIEF DESCRIPTION OF THE DRAWINGS

So that the manner in which the above recited features of the present invention operate can be understood in detail, a more particular description of the invention, briefly summarized above, may be had by reference to embodiments, some of which are illustrated in the appended drawings. It is to be noted, however, that the appended drawings only illustrate typical embodiments of this invention and are therefore not to be considered limiting of its scope, for the invention may admit to other equally effective embodiments.

DETAILED DESCRIPTION OF THE PREFERRED EMBODIMENT

Figure 1:
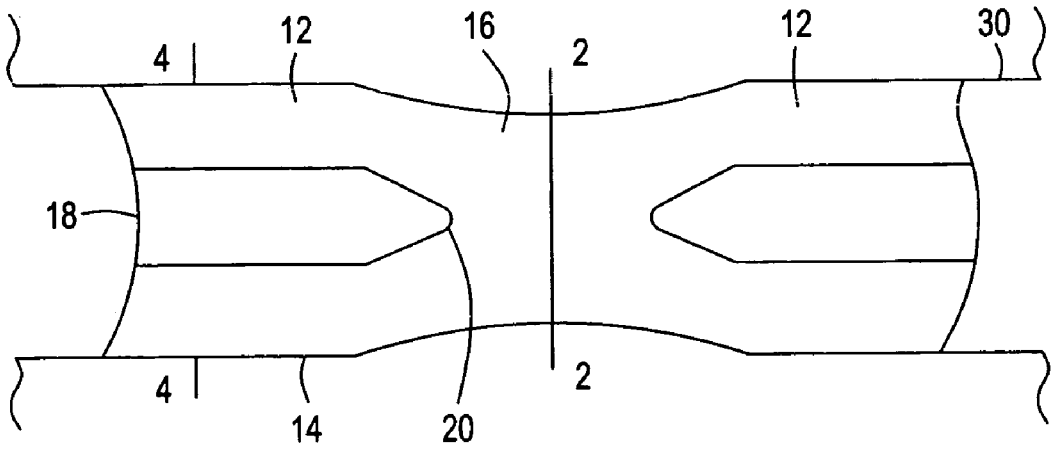
FIG. 1 is a schematic view of a section of deformable downhole tubing in accordance with an embodiment of the present invention.

It is among the objectives of embodiments of the present invention to facilitate use of folded tubing in downhole applications, and in particular to permit use of tubing made up from a plurality of folded pipe sections which may be coupled to one another at surface before being run into the bore.

According to a first aspect of the present invention there is provided downhole apparatus comprising a plurality of tubing sections, each tubing section having substantially cylindrical end portions initially of a first diameter for coupling to end portions of adjacent tubing sections and being expandable at least to a larger second diameter, and intermediate folded wall portions initially in a folded configuration and being unfoldable to define a substantially cylindrical form at least of a larger third diameter.

The invention also relates to a method of lining a bore using such apparatus. Thus, the individual tubing sections may be coupled together via the end portions to form a string to be run into a bore. The tubing string is then reconfigured to assume a larger diameter configuration by a combination of mechanisms, that is at least by unfolding the intermediate portions and expanding the end portions. The invention thus combines many of the advantages available from folded tubing while also taking advantage of the relative ease of coupling cylindrical tubing sections; previously, folded tubing has only been proposed as continuous reelable lengths, due to the difficulties that would be involved in coupling folded tubing sections.

Preferably, transition portions are be provided between the end portions and the intermediate portions, and these portions will be deformable by a combination of both unfolding and expansion. The intermediate wall portion, transition portions and end portions may be formed from a single piece of material, for example from a single extrusion or a single formed and welded sheet, or may be provided as two or more parts which are assembled. The different parts may be of different materials or have different properties. The end portions may be foldable, and may have been previously folded. Alternatively, or in addition, the end portions may be folded following coupling or making up with other end portions. This would allow cylindrical tubing sections to be made up on site, and then lowered into a well through a set of rollers which folded the tubulars including the end portions, into an appropriate, smaller diameter folded configuration. Indeed, in certain aspects of the invention the end portion may only be subject to unfolding, and may not experience any expansion.

The end portions may be provided with means for coupling adjacent tubing sections. The coupling means may be in the form of male or female threads which allow the tubing sections to be threaded together. Alternatively, or in addition, the coupling means may comprise adhesive or fasteners, such as pins, bolts or dogs, or may provide for a push or interference type coupling. Other coupling means may be adapted to permit tubing section to be joined by welding or by amorphous bonding. Alternatively, or in addition, the apparatus may further comprise expandable tubular connectors. In one embodiment, an expandable connector may define female threads for engaging male threaded end portions of the tubing sections.

Preferably, the first diameter is smaller than the third diameter. The second and third diameters may be similar. Alternatively, the unfolded intermediate wall portions may be expandable from the third diameter to a larger fourth diameter, which fourth diameter may be similar to the second diameter.

According to another aspect of the present invention there is provided a method of creating a bore liner, the method comprising providing a tubing section having a folded wall and describing a folded diameter; running the tubing section into a bore; unfolding the wall of the tubing section to define a larger unfolded diameter; and expanding the unfolded wall of the tubing section to a still larger diameter. This unfolding and expansion of the tubing section is useful in achieving relatively large expansion ratios which are difficult to achieve using conventional mechanisms, and also minimising the expansion forces necessary to achieve desired expansion ratios.

The unfolding and expansion steps may be executed separately, or may be carried out in concert. One or both of the unfolding and expansion steps may be achieved by passing an appropriately shaped mandrel or cone through the tubing, by applying internal pressure to the tubing, or preferably by rolling expansion utilising a rotating body carrying one or more rolling members, most preferably a first set of rolling members being arranged in a conical form or having a tapered form to achieve the initial unfolding, and a further set of rolling members arranged to be urged radially outwardly into contact with the unfolded tubing section wall. Of course, the number and configuration of the rolling member sets may be selected to suit particular applications or configurations. The initial deformation or unfolding may be achieved by simple bending of the tubing wall, and subsequent expansion by radial deformation of the wall, reducing the wall thickness and thus increasing the wall diameter.

The tubing section may be reelable, but is preferably formed of jointed pipe, that is from a plurality of shorter individual pipe sections which are connected at surface to make up a tubing string. Alternatively, the tubing section may be in the form of a single pipe section to be used as, for example, a straddle.

Preferably, an upper portion of the tubing section is deformed initially, into contact with a surrounding wall, to create a hanger and to fix the tubing section in the bore. Most preferably, said upper portion is initially substantially cylindrical and is expanded to create the hanger. The remainder of the tubing section may then be unfolded and expanded.

The tubing section may be expanded into contact with the bore wall over some or all of the length of the tubing section. Where an annulus remains between the tubing section and the bore wall this may be filled or partially filled by a settable material, typically a cement slurry. Cementation may be carried out before or after expansion. In other embodiments, a deformable material, such as an elastomer, may be provided on all or part of the exterior of the tubing section, to facilitate formation of a sealed connection with a surrounding bore wall or surrounding tubing.

Figure 2:
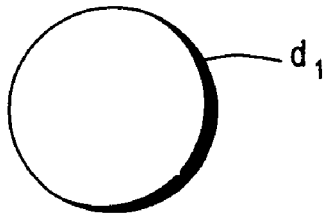
FIG. 2 is a sectional view on line 2—2 of FIG. 1.
Figure 3:
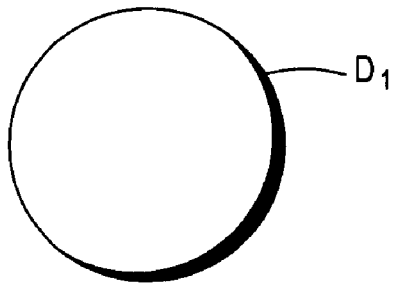
FIG. 3 is a sectional view corresponding to FIG. 2, showing the tubing following expansion.
Figure 4:
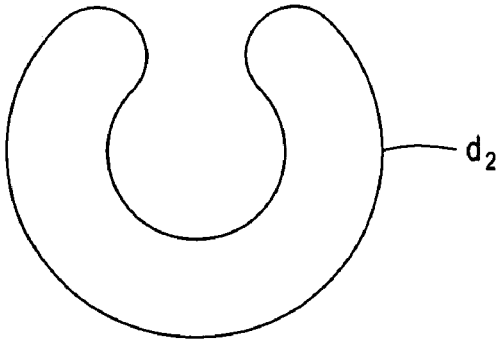
FIG. 4 is a sectional view on line 4—4 of FIG. 1.

Reference is first made to FIG. 1 of the drawings, which illustrates downhole tubing 10 in accordance with a preferred embodiment of the present invention. The tubing 10 is made up of a plurality of tubing sections 12, the ends of two sections 12 being illustrated in FIG. 1. Each tubing section 12 defines a continuous wall 14 such that the wall 14 is fluid tight. Each tubing section 12 comprises two substantially cylindrical end portions 16 which are initially of a first diameter $d_1$ (FIG. 2) and, as will be described, are expandable to a larger second diameter $D_1$ (FIG. 3). However, the majority of the length of each tubing section 12 is initially in a folded configuration, as illustrated in FIG. 4, describing a folded diameter $d_2$ and, as will be described, is unfoldable to a substantially cylindrical form of diameter $D_2$, and subsequently expandable to the same or similar diameter $D_1$ as the expanded end portions 16. Between the end portions 16 and intermediate portions 18 of each tubing section 12 are transition portions 20 which are adapted to be deformed by a combination of unfolding and expansion to the diameter $D_1$.

In use, the tubing sections 12 may be coupled together on surface in a substantially similar manner to conventional drill pipe. To this end, the tubing section end portions 16 are provided with appropriate pin and box couplings. The thus formed tubing string may be run into a drilled bore 30 to an appropriate depth, and the tubing string then unfolded and expanded to create a substantially constant bore larger diameter tubing string of diameter $D_1$. The unfolding and the expansion of the tubing string may be achieved by any appropriate method, though it is preferred that the expansion is achieved by means of a rolling expander, such as described in WO00\37771, and U.S. Ser. No. 09/469,643, the disclosures which are incorporated herein by reference. The running and expansion process will now be described in greater detail with reference to FIG. 5 of the accompanying drawings.

Figure 5:
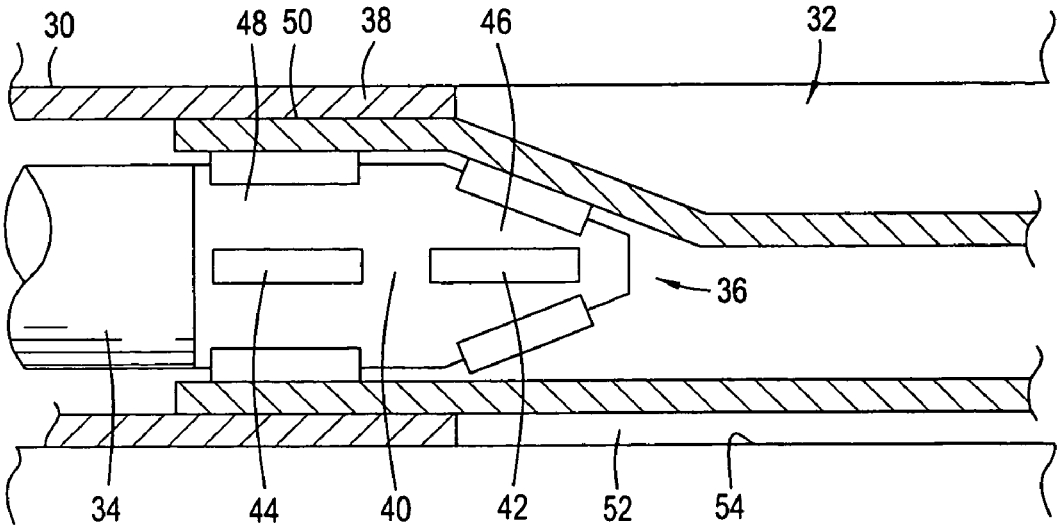
FIG. 5 is a schematic view of a step in the installation of a tubing string in accordance with an embodiment of the present invention.

FIG. 5 of the drawings illustrates the upper end of a tubing string 32 which has been formed from a plurality of tubing sections 12 as described above. The string 32 has been run into a cased bore 30 on the end of a running string 34, the tubing string 32 being coupled to the lower end of the running string 34 via a swivel (not shown) and a roller expander 36. In this particular example the tubing string 32 is intended to be utilised as bore-lining casing and is therefore run into a position in which the upper end of the string 32 overlaps with the lower end of the existing bore-lining casing 38.

The expander 36 features a body 40 providing mounting for, in this example, two sets of rollers 42, 44. The lower or leading set of rollers 42 are mounted on a conical body end portion 46, while the upper or following set of rollers 44 are mounted on a generally cylindrical body portion 48. The rollers 44 are mounted on respective pistons such that an increase in the fluid pressure within the running string 34 and the expander body 40 causes the rollers 44 to be urged radially outwardly.

On reaching the desired location, the fluid pressure within the running string 34 is increased, to urge the rollers 44 radially outwardly. This deforms the tubing section end portion 16 within which the roller expander 36 is located, to create points of contact between the tubing section end portion outer surface 50 and the inner face of the casing 38 at each roller location, creating an initial hanger for the tubing string 32. The running string 34 and roller expander 36 are then rotated. As the tubing string 32 is now held relative to the casing 38, the swivel connection between the roller expander 36 and the tubing 32 allows the expander 36 to rotate within the upper end portion 16. Such rotation of the roller expander 36, with the rollers 44 extended, results in localised reductions in thickness of the wall of the tubing section upper end portion 16 at the roller locations, and a subsequent increase in diameter, such that the upper end portion 16 is expanded into contact with the surrounding casing 38 to form a tubing hanger.

With the fluid pressure within the running string 34 and roller expander 36 being maintained, and with the expander 36 being rotated, weight is applied to the running string 34, to disconnect the expander 36 from the tubing 32 by activating a shear connection or other releasable coupling. The expander 36 then advances through the tubing string 32. The leading set of rollers 42 will tend to unfold the folded wall of the transition portion 20 and then the intermediate portion 18, and the resulting cylindrical tubing section is then expanded by the following set of rollers 44. Of course, as the expander 36 advances through the string 32, the expansion mechanisms will vary as the expander 36 passes through cylindrical end portions 16, transitions portions 20, and folded intermediate portions 18.

Once the roller expander 36 has passed through the length of the string 32, and the fluid pressure within the running string 34 and expander 36 has been reduced to allow the rollers 44 to retract, the running string 34 and expander 36 may be retrieved through the unfolded and expanded string 32. Alternatively, before retrieving the running string 34 and expander 36, the expanded string 32 may be cemented in place, by passing cement slurry down through the running string 34 and into the annulus 52 remaining between the expanded string 32 and the bore wall 54.

It will be apparent to those of skill in the art that the above-described embodiment is merely exemplary of the present invention, and that various modifications and improvements may be made thereto without departing from the scope of the invention. For example, the tubing described in the above embodiment is formed of solid-walled tube. In other embodiments the tube could be slotted or otherwise apertured, or could form part of a sandscreen. Alternatively, only a relatively short length of tubing could be provided, for use as a straddle or the like. Also, the above described embodiment is a "C-shaped" folded form, and those of skill in the art will recognise that the present application has application in a range of other configuration of folded or otherwise deformed or deformable tubing. Further, the present invention may be useful in creating a lined monobore well, that is a well in which the bore-lining casing is of substantially constant cross-section. In such an application, the expansion of the overlapping sections of casing or liner will be such that the lower end of the existing casing is further expanded by the expansion of the upper end of the new casing.

Figure 6:
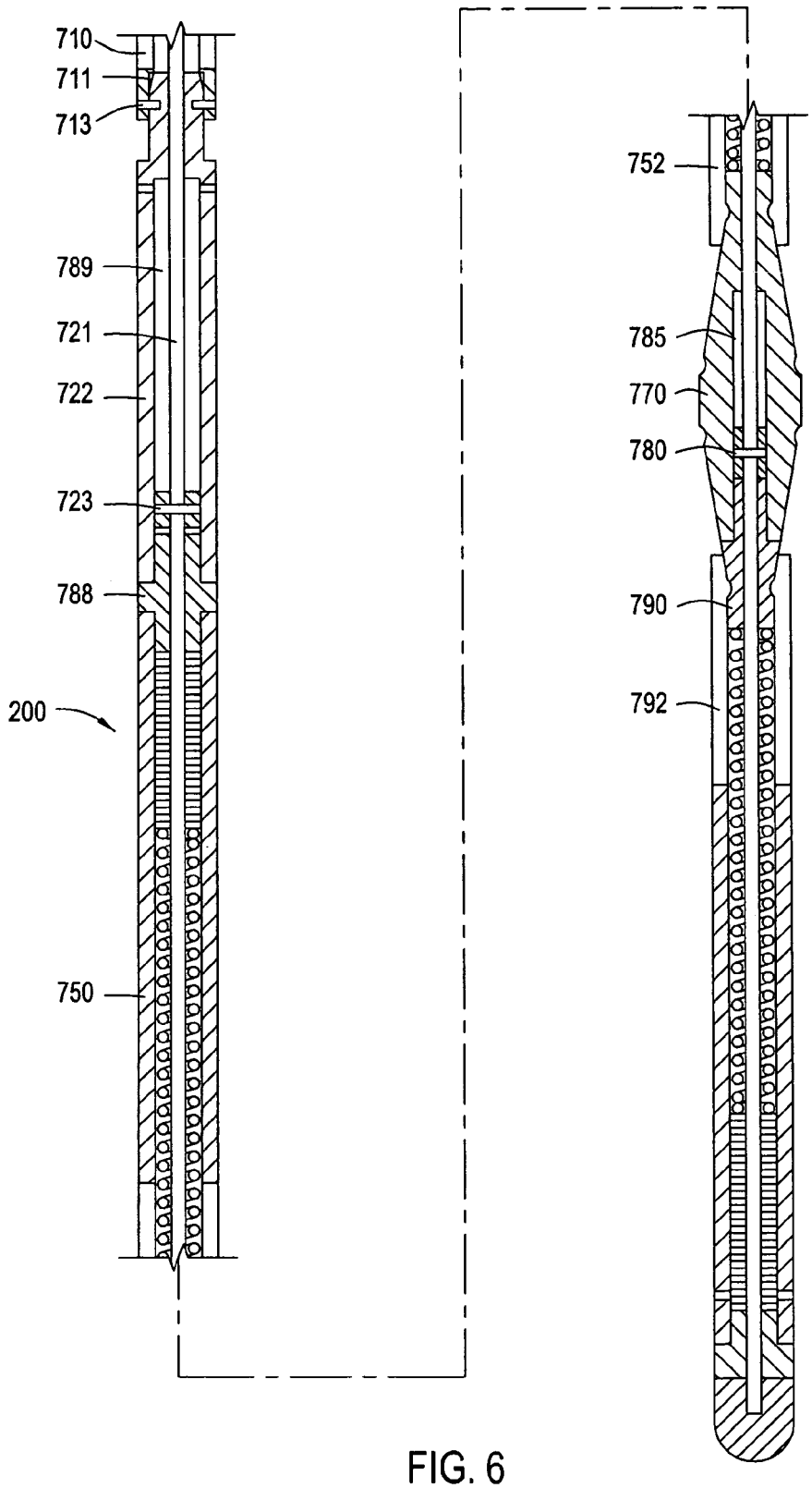
FIG. 6 is a cross-sectional view of a lower portion of a corrugated casing string with an expander tool disposed at the lower portion of the casing string.

FIG. 6 depicts an expander tool 200 which may be used to reform a corrugated casing string 710. This description refers to 710 as the corrugated casing string; however, any type of tubular body is contemplated for use with the present invention, including but not limited to a casing patch. The expander tool 200 is disclosed in U.S. Pat. No. 6,142,230, issued to Smalley et al. on Nov. 7, 2000, which is herein incorporated by reference in its entirety. The expander tool 200 is releasably attached to the corrugated casing string 710 during run-in, preferably by shear pins 713, to initially prevent the expander tool 200 from entering the corrugated casing string 710.

The expander tool 200 includes opposing expandable collet fingers 752, 792 which move outward radially to reform the casing string 710 from the bottom up after the casing string 710 has been located below a restricted area, in this case a casing 730 (see FIG. 7). A cone 711 is located directly below the casing string 710 so that a tapered end portion of the cone 711 either initially touches or is closely adjacent a lower end of the casing string 710.

An upper piston 723 is movable within an annular area 789 between a piston housing 722 and an interior channel 721 of the cone 711. A lower end of the piston housing 722 is threadedly connected to a spring seat 788. The upper piston 723 moves the cone 711 upward through the casing string 710 to begin to reform the casing string 710 from the bottom up. An upper end of an upper collet 750 is threadedly connected to a lower end of the spring seat 788.

The means for reforming the corrugated casing string 710 is a collet expander 770. Opposing collet fingers 752, 792 of the collet expander 770 are located on the upper collet 750 and a lower collet 790, respectively. The collet fingers 752, 792 are staggered in relation to one another, or offset diametrically relative to one another, along the diameter of the upper and lower collets 750 and 790. The collet fingers 752, 792 are movable outward over the collet expander 770 by upward movement of a lower piston 780 within an annular area 785 between the collet expander 770 and the interior channel 721. Because the collet fingers 752, 792 are opposing and staggered relative to one another, the collet fingers 752, 792 move over the collet expander 770 to engage one another and close the gaps between the staggered collet fingers 752, 792, providing a continuous surface for expanding. The expander tool 200 is compliant when the collet fingers 752, 792 engage one another, as the expander tool 200 may reform the casing string 710 uniformly around the diameter of the casing string 710.

Figure 15:
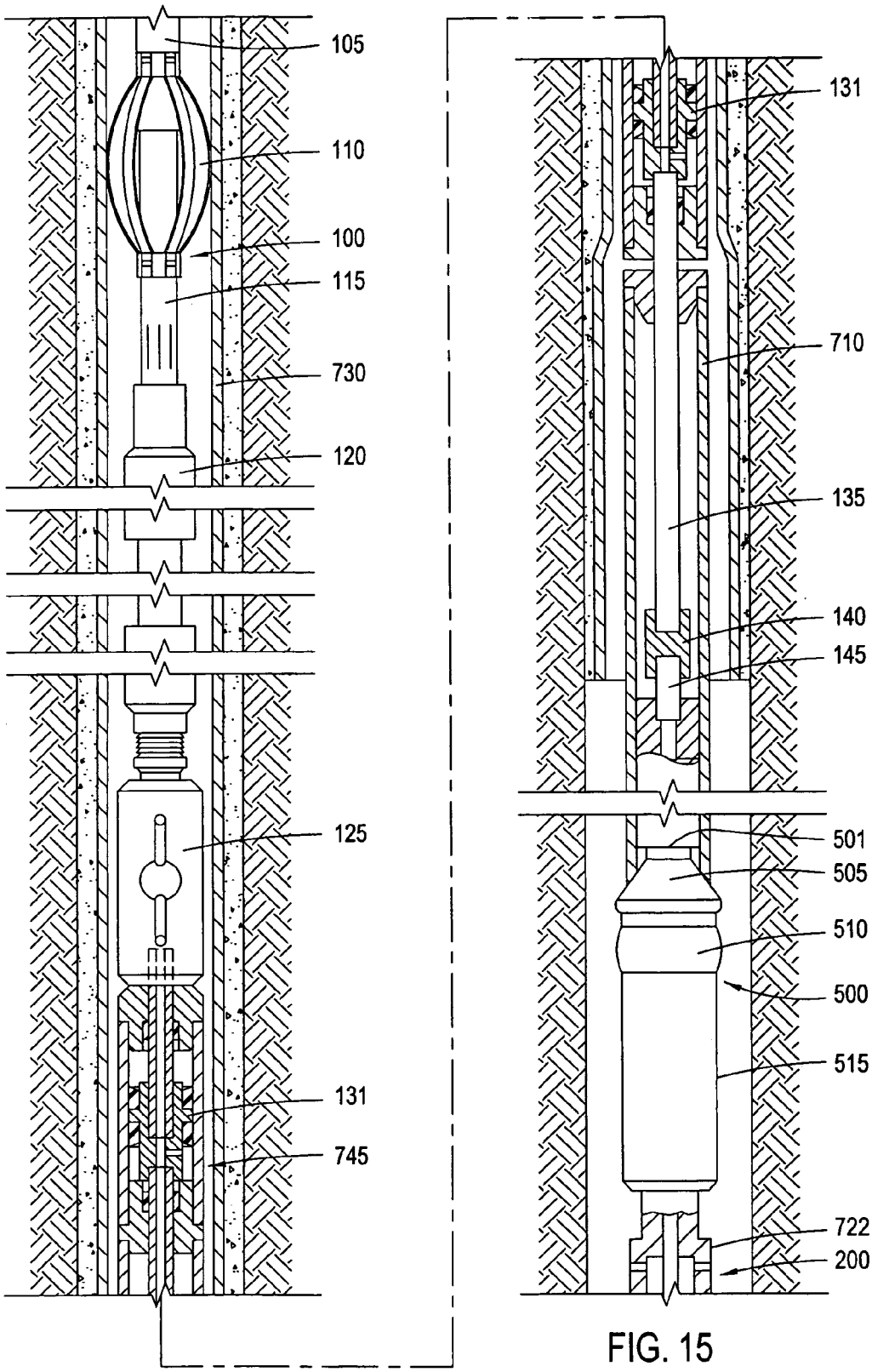
FIG. 15 is a cross-sectional view of an alternate embodiment of the present invention in the run-in configuration. A system which may be used to reform a corrugated casing string in one run-in of expander tools is shown disposed in a partially cased wellbore. The system includes expander tools connected to one another and releasably attached to the corrugated casing string.

FIG. 15 shows a system 100 which may be utilized with the expander tool 200 of the present invention. Instead of a cone expander 500 as shown in FIG. 15, the cone 711 of the expander tool 200 is threadedly connected to the system at 501, so that the expander tool 200 is located within and below the casing 710, as shown in FIG. 6. The system 100 includes an upper connection 105, which may be used to threadedly connect the system 100 to a working string (not shown) to run the system 100 in from a surface (not shown) of a wellbore 715 (see FIG. 7). The system 100 includes a centralizer 110, a slide valve 115, a bumper jar 120, a hydraulic hold down 125, and a setting tool 745. The setting tool 745 has pistons 131 located therein which are movable in response to hydraulic pressure. The setting tool 745 is connected by a polish rod 135 and an extending rod 140 to the expander tool 200. A safety joint 145 may be used to connect the expander tool 200 to the other parts of the system 100.

Figure 7:
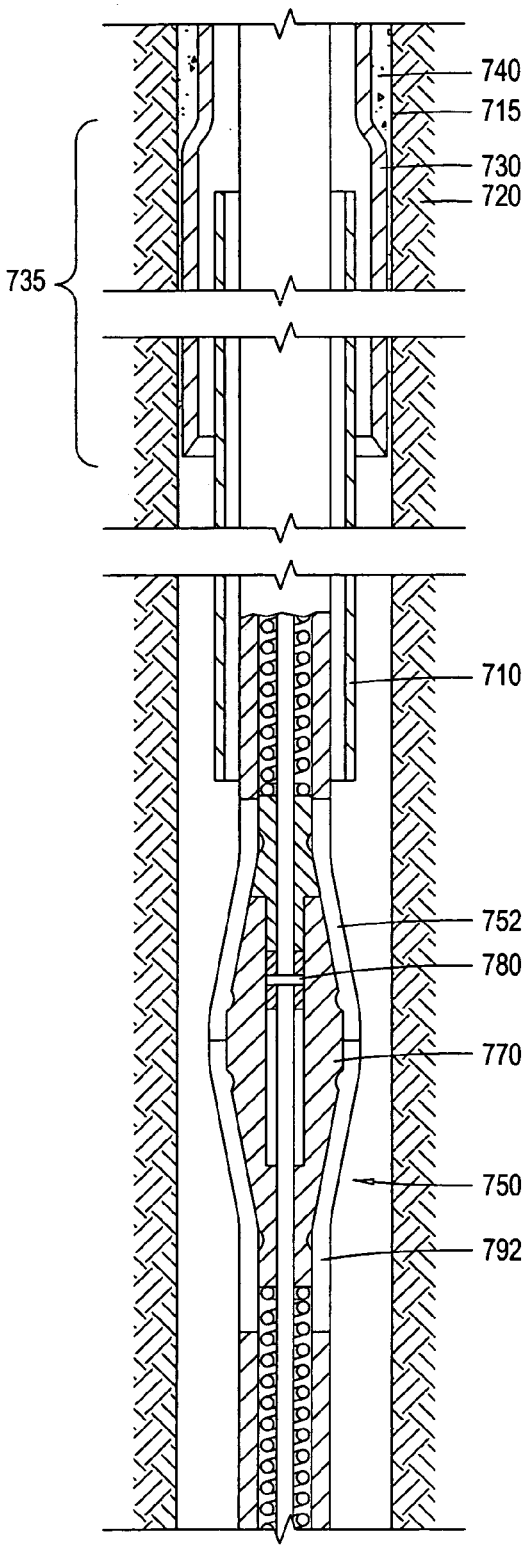
FIG. 7 is a cross-sectional view of the corrugated casing string with a portion of the expander tool of FIG. 6 attached. The assembly is run into an open hole portion of a cased wellbore.
Figure 8:
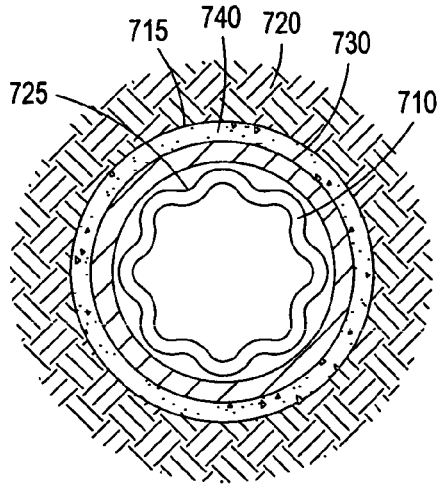
FIG. 8 is a downward view of the corrugated casing string of FIG. 7 disposed within the wellbore.
Figure 9:
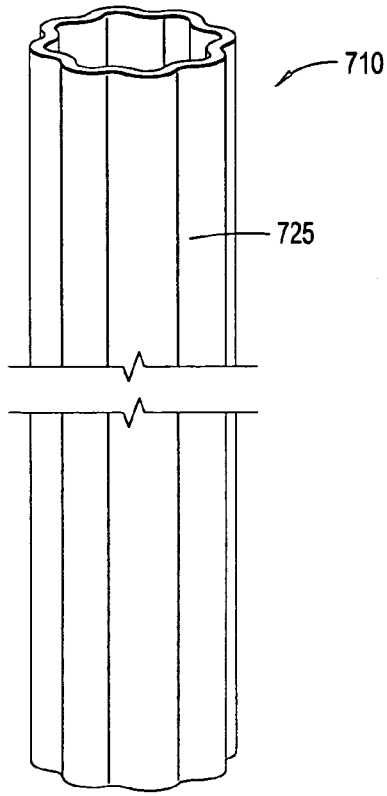
FIG. 9 is a sectional view of the corrugated casing string of FIG. 7.

FIG. 8 shows the corrugated casing string 710 disposed within the wellbore 715 formed in a formation 720. As described above, the setting tool 745 is disposed within the casing string 710. The expander tool 200, connected to the lower end of the setting tool 745, is shown in FIG. 8 moved upward within the casing string 710. The casing string 710 of FIG. 7 is deformed, preferably prior to insertion into the wellbore 715, to a shape other than tubular-shaped so that it is corrugated or crinkled to form grooves 725 within the casing string 710, as shown in FIGS. 8 and 9. A tubular-shaped body is generally cylindrical. As depicted in FIG. 9, the grooves 725 are formed along the length of the casing string 710. The shape of the corrugated casing string 710 and the extent of corrugation of the casing string 710 is not limited to the shape depicted in FIGS. 8 and 9. The grooves 725 may be symmetric or asymmetric. The only limitation on the shape of the corrugated casing string 710 and the extent of the corrugations of the casing string 710 is that the casing string 710 must not be deformed in such a fashion that reformation of the casing string 710 (see below) causes sufficient stress on any particular portion of the casing string 710 to permit the casing string 710 to fracture in that portion upon reformation. Smalley et al., above incorporated by reference, shows and explains configurations of the corrugated casing string 710 which may be utilized with the present invention.

The casing string 710 may be dispensed from a spool (not shown) at the surface of the wellbore 715. Alternatively, the casing string 710 may be provided in sections at the wellbore 715 and connected by welding or bonding the sections together. When the casing string 710 is dispensed from a spool, the casing string 710 may be twisted while running the casing string 710 into the wellbore 715 from the spool to produce a smaller apparent diameter of the casing string 710 running into the wellbore 715, thus allowing the casing string 710 to run through more restricted areas in the wellbore 715.

FIG. 7 also shows casing 730 disposed within the wellbore 15. The casing 730 is set within the wellbore 715 by cement 740. A lower portion 735 of the casing 730 has a larger inner diameter than the remaining portions of the casing 730. In this way, the lower portion 735 is designed to receive the subsequent casing string 710 used to form the substantially monobore well.

Figure 11:
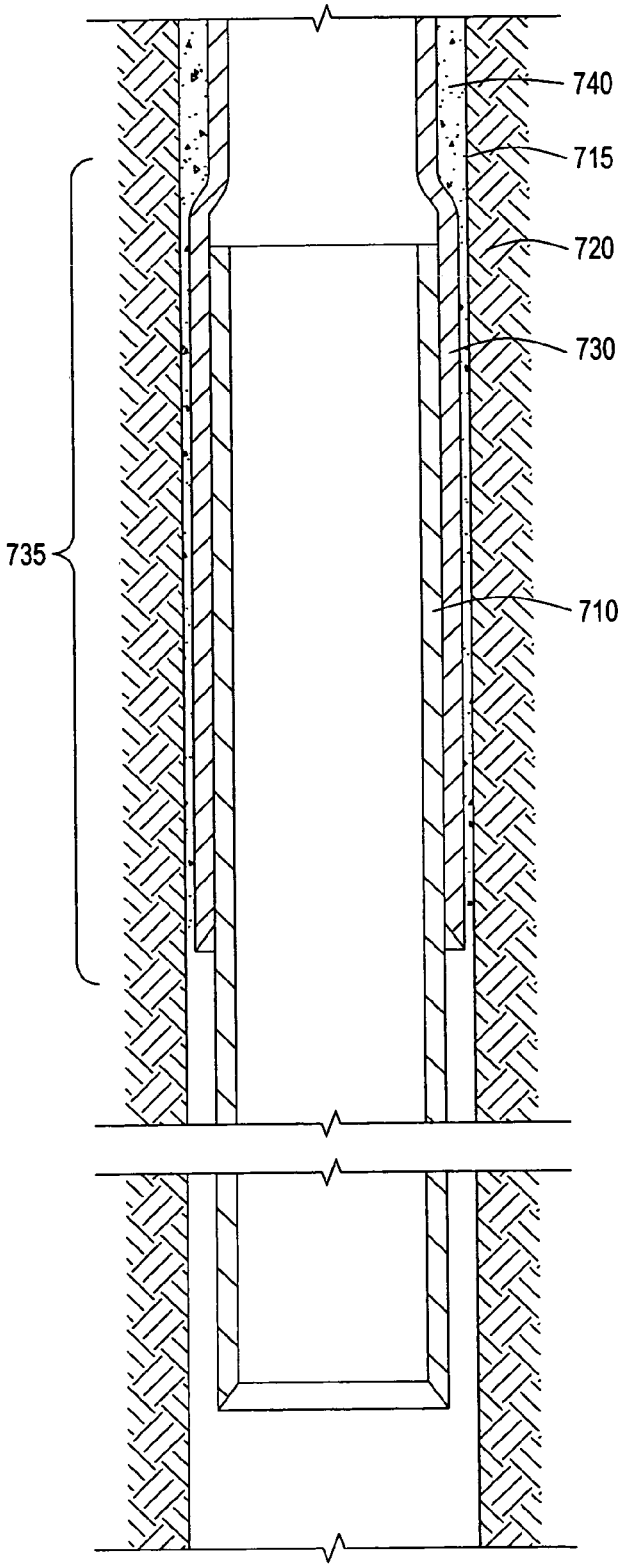
FIG. 11 is a cross-sectional view of the reformed casing string. An upper portion of the casing string is reformed into contact with a lower portion of the casing previously disposed within the wellbore.
Figure 12:
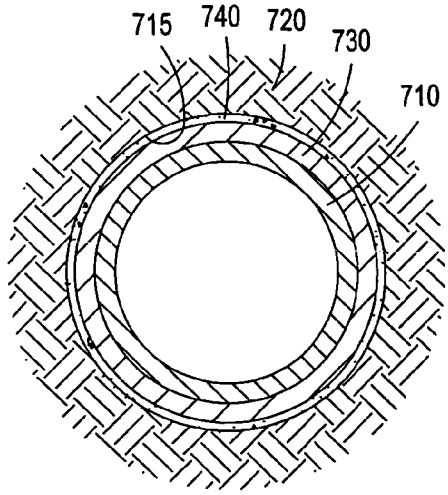
FIG. 12 is a downward view of the reformed casing string of FIG. 10 disposed within the wellbore.
Figure 13:
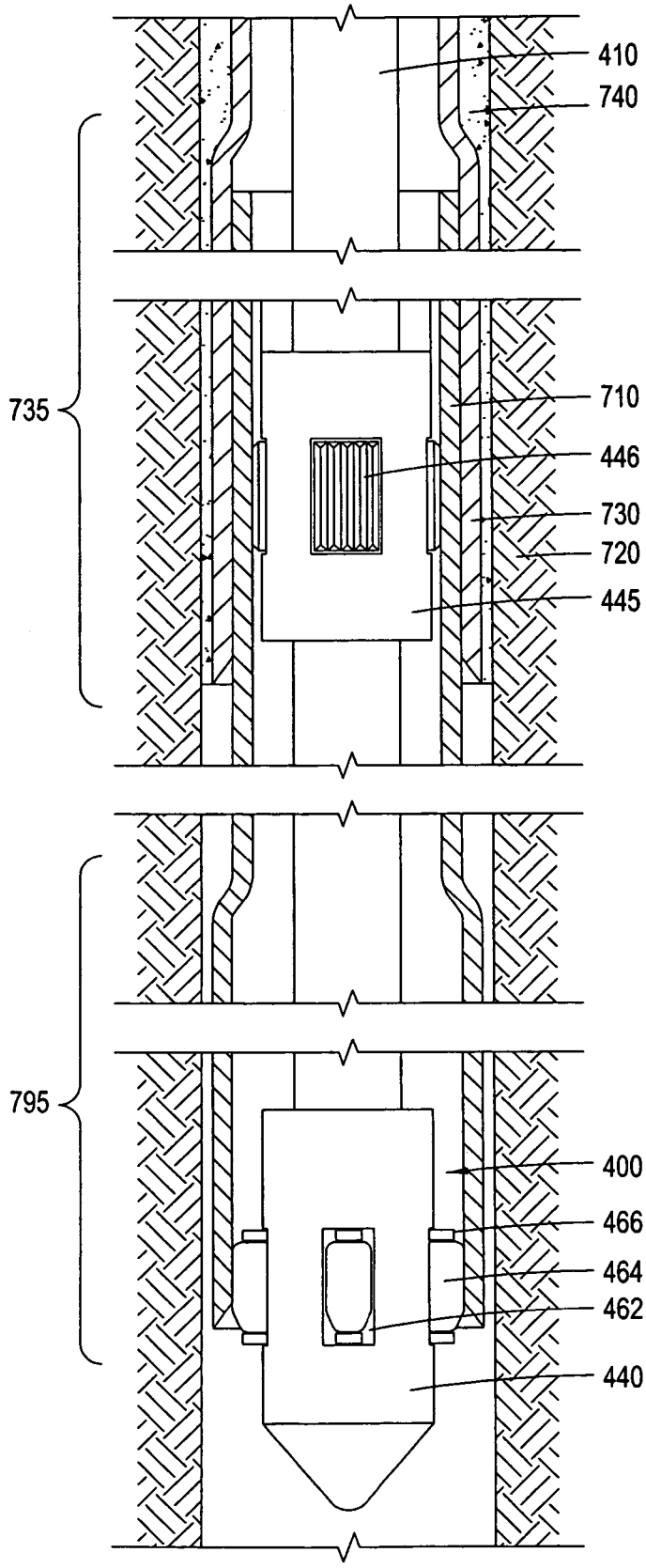
FIG. 13 is a cross-sectional view of the reformed casing string disposed within the wellbore. A lower portion of the reformed casing string is shown expanded past its elastic limit by a compliant expander tool.

FIGS. 11 and 12 show the casing string 710 after the reformation process. The casing string 710 is no longer corrugated, but essentially tubular-shaped. FIG. 13 illustrates a compliant expander tool 400 run into the wellbore 715 on a working string 410. The working string 410 may have a torque anchor 445 disposed thereon with slip members 446 for initially anchoring the expander tool 400 within the casing string 710. The expander tool 400 is used to expand a lower portion 795 of the casing string 710 past its elastic limit, thereby strengthening the lower portion 795 as well as providing a place into which to reform a subsequent casing string (not shown). The expander tool 400 is described in U.S. patent application Ser. No. 10/034,592, filed on Dec. 28, 2001, which application is herein incorporated by reference in its entirety.

The hydraulically-actuated expander tool 400 has a central body 440 which is hollow and generally tubular. The central body 440 has a plurality of windows 462 to hold respective rollers 464. Each of the windows 462 has parallel sides and holds a roller 464 capable of extending radially from the expander tool 400. Each of the rollers 464 is supported by a shaft 466 at each end of the respective roller 464 for rotation about a respective rotational axis. Each shaft 466 is formed integral to its corresponding roller 464 and is capable of rotating within a corresponding piston (not shown). The pistons are radially slidable, each being slidably sealed within its respective radially extended window 462. The back side of each piston is exposed to the pressure of fluid within the annular space between the expander tool 400 and the working string 410. In this manner, pressurized fluid supplied to the expander tool 400 may actuate the pistons and cause them to extend radially outward into contact with the lower portion 795 of the casing string 710.

The expander tool 400 may include a translating apparatus (not shown) for axially translating the expander tool 400 relative to the casing string 710. The translating apparatus includes helical threads formed on the working string 410. The expander tool 400 may be operatively connected to a nut member (not shown) which rides along the threads of the working string 410 when the working string 410 is rotated. The expander tool 400 may further include a recess (not shown) connected to the nut member for receiving the working string 410 as the nut member travels axially along the working string 410. The expander tool 400 is connected to the nut member in a manner such that translation of the nut member along the working string 410 serves to translate the expander tool 400 axially within the wellbore 715.

In one embodiment, a motor (not shown) may be used to rotate the working string 410 during the expansion process. The working string 410 may further include one or more swivels (not shown) to permit the rotation of the expander tool 400 without rotating other tools downhole. The swivel may be provided as a separate downhole tool or incorporated into the expander tool 400 using a bearing-type connection (not shown).

In operation, casing 730 is lowered into the wellbore 715. The lower portion 735 is expanded by an expander tool, such as the expander tool 400 or the expander tool 200, so that the lower portion 735 has a larger inner diameter than the remaining portions of the casing 730. Cement 740 is introduced into the casing 730 and flows around the casing 730 to fill an annular space between an inner diameter of the wellbore 715 and an outer diameter of the casing 730. The casing 730 cemented within the wellbore 715 forms a partially cased wellbore with an open hole portion below the casing 730, as shown in FIG. 7.

The corrugated casing string 710 is then run into the wellbore 715 with the expander tool 200 releasably connected to the lower end of the casing string 710, as shown in FIG. 6. The system 100 of FIG. 15 is threadedly connected at 501 to the cone 711 of the expander tool 200 so that a portion of the system 100 is located above the casing string 710 and a portion of the system 100 is located within the casing string 710. Upon run-in, the collet fingers 752, 792 are retracted, as shown in FIG. 6.

As described above, the casing string 710 is corrugated upon run-in, as shown in FIGS. 8 and 9. Running in the casing string 710 in this collapsed form allows the casing string 710 to fit through the casing 730 disposed within the wellbore 715 (see FIG. 7). As illustrated in FIG. 7, the casing string 710 is lowered to a depth within the wellbore 715 at which an upper portion of the casing string 710 overlaps the lower portion 735 of the casing 730. A remaining portion of the casing string 710 is located within the open hole portion of the wellbore 715. FIG. 7 shows the casing string 710 in position for reformation within the wellbore 715.

Figure 16:
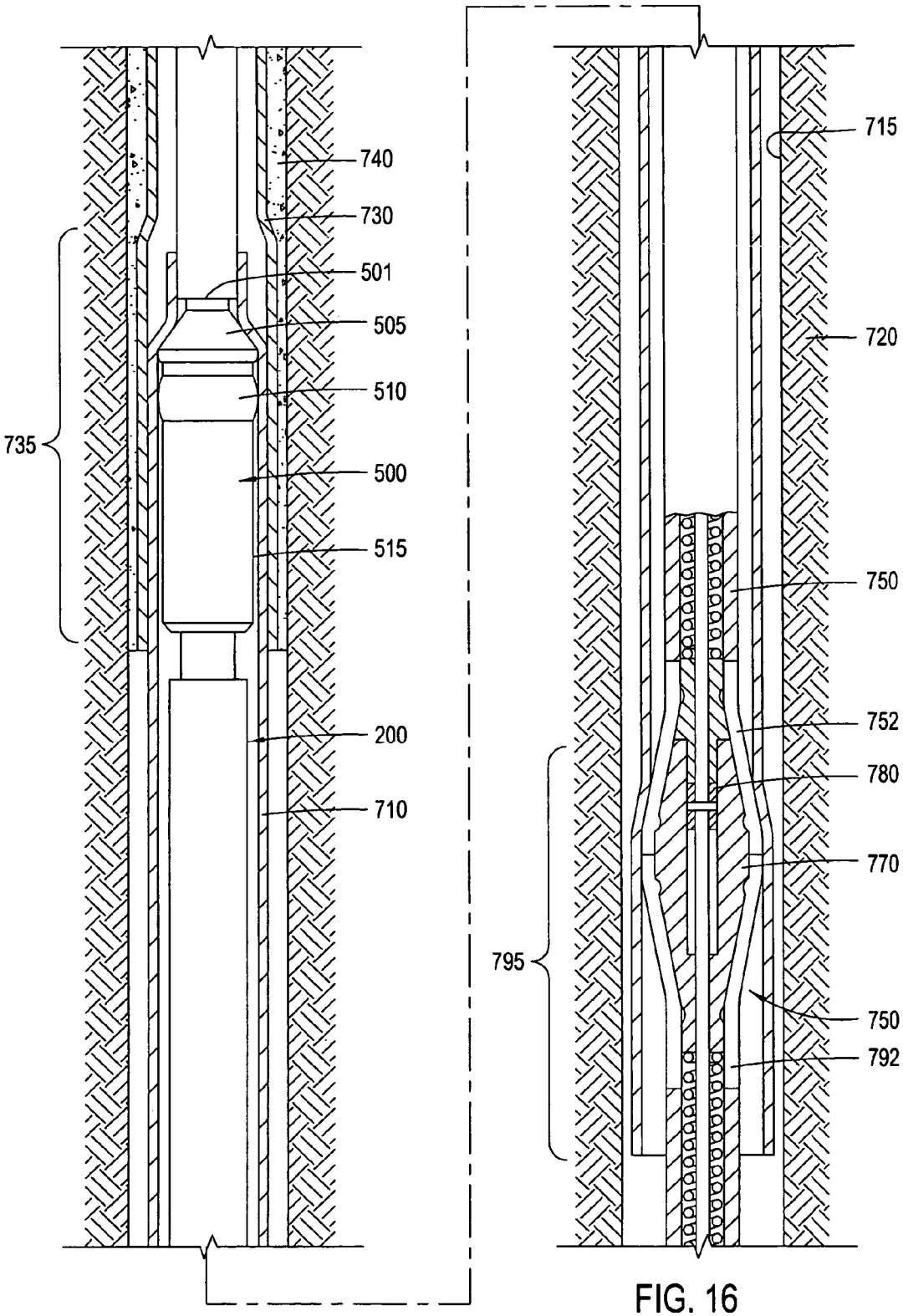
FIG. 16 is a cross-sectional view of FIG. 15 in a partially cased wellbore, wherein the system is reforming the corrugated casing string and expanding a lower portion of the casing string in the same run-in of the expander tools.

Once the casing string 710 is in position at the lower portion 735 of the casing 730, the system 100 of FIGS. 15–16 connected to the upper end of the expander tool 200 is activated so that the working string (not shown) is raised to close the circulating slide valve 115. Pressurized fluid is circulated through the system 100, forcing out movable buttons on the hydraulic hold down 125. The hydraulic hold down 125 anchors the system at the desired location in the casing 730 and isolates the working string from tensile loads associated with the setting operation.

Fluid pressure is maintained at about 1000 p.s.i. so that fluid behind the upper piston 723 moves the collet expander 770 downward with respect to the lower piston 780, forcing the collet fingers 752, 792 over the collet expander 770 and thus outward toward the wellbore 715. Fluid pressure is then increased to shear the cone shear pins 713, e.g., to about 1500 p.s.i., thus freeing the cone 711 for upward movement into the casing string 710. FIG. 7 shows the shear pins 713 sheared and the cone 711 and the rest of the expander tool 200 moving upward through the casing string 710.

Figure 10:
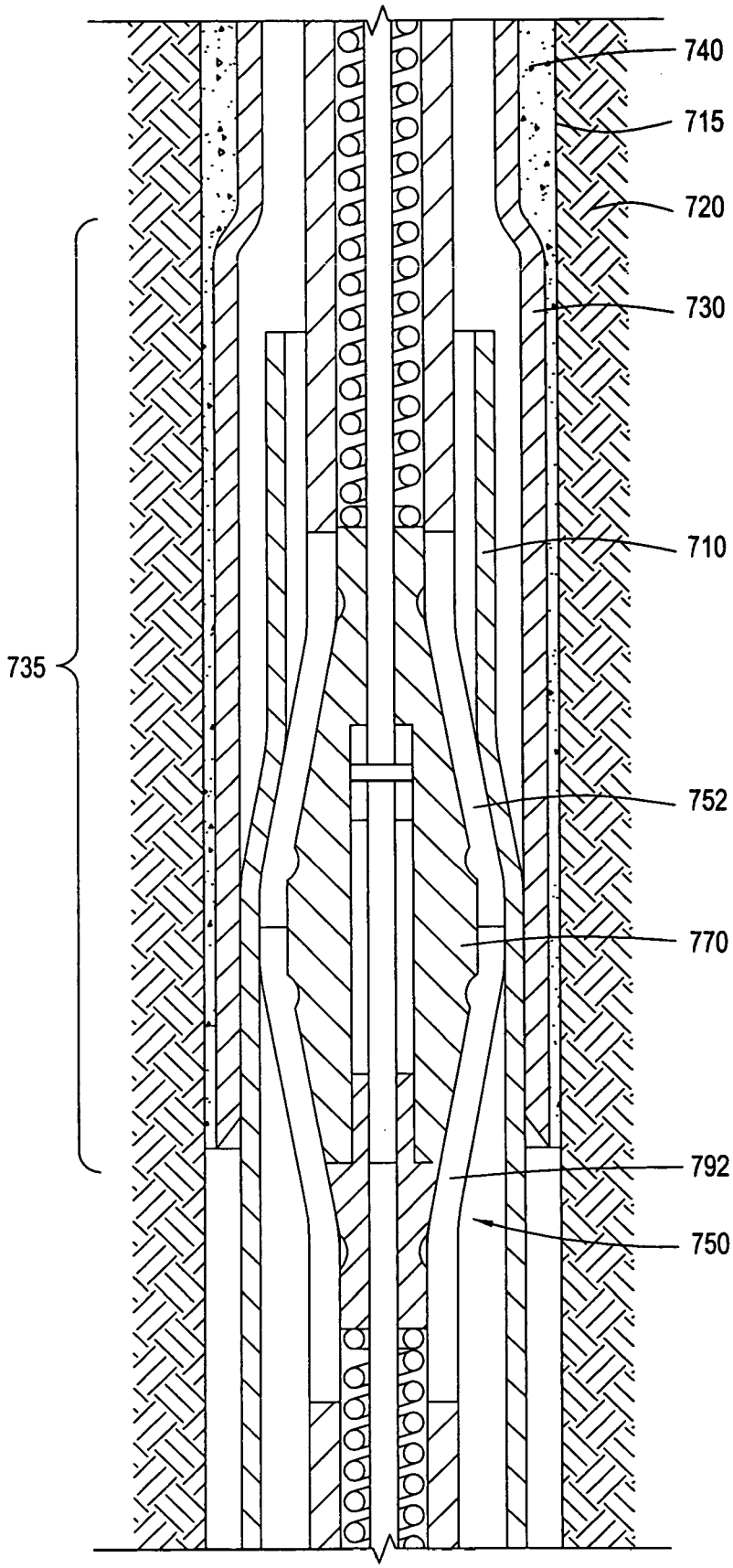
FIG. 10 is a cross-sectional view of the corrugated casing string being reformed by the expander tool, showing a portion of the expander tool.

Next, pressure is increased, e.g., to 3500 p.s.i. to 5000 p.s.i., to pull the collet assembly 750 through the casing string 710 as fluid behind the piston 131 in the setting tool 745 (see FIGS. 15–16) pulls the expanded collet assembly 750 through the casing string 710 to reform the casing string 710. FIG. 10 shows the expander tool 200 pulled up through the casing string 710, with the collet assembly 750 reforming the casing string 710 from the bottom up. During the reformation process, the expander tool 200 basically "irons out" the crinkles in the corrugated casing string 710 so that the casing string 710 is reformed into its initial tubular shape.

Fluid circulation is then stopped by lowering the working string (not shown) to open the slide valve 115, and the system 100 is pulled up on to re-set the setting tool 745 and re-stroke hydraulic cylinders in the setting tool 745. Specifically, the working string is raised to pull up the dual cylinders of the setting tool 745 in relation to pistons 131 held down by the expander tool 200. A section of the casing string 710 is reformed by friction caused by compressive hoop stress. Hydraulic pressure is again applied to the casing string 710 after closing the slide valve 115. Next, the hydraulic hold down buttons 130 are expanded again to reform the casing string 710 at a new, higher position, and the above cycle is repeated until reformation of the casing string 710 is achieved. FIG. 16 shows hydraulic fluid pressure on the underside of the pistons 131 of the setting tool 745 pulling a cone 500 into the bottom of the corrugated casing string 710. The cone 500 in this embodiment is replaced with the expander tool 200 of FIG. 10. As pressure increases, the expander tool 200 is forced further upward into the casing string 710, so that the collet fingers 752, 792 reform the casing string 710 into a tubular body.

After the casing string 710 is reformed along its length, the setting tool 745 and expander tool 200 are removed from the wellbore 715. The casing string 710 remains within the wellbore 715. FIG. 11 depicts the reformed casing string 710 within the wellbore 715. FIG. 12 shows the tubular shape of the reformed casing string 710.

After completion of the reformation of the deformed casing string 710, the lower portion 795 of the casing string 710 is expanded past its elastic limit so that the lower portion 795 has a larger inner diameter than the remaining portions of the casing string 710 to subsequently receive additional casing strings (not shown). The expander tool 400 is run into the inner diameter of the casing 730 and casing string 710 on the working string 410. During run-in, the rollers 464 of the expander tool 400 are unactuated. Once the expander tool 400 is run into the desired depth within the casing string 710 at which to expand the lower portion 795, hydraulic fluid is introduced into the working string 410 to force the rollers 464 to contact and expand the lower portion 795 of the casing string 710. The pressure also actuates the motor, which rotates the expander tool 400 relative to the casing string 710. The roller extension and rotation deform the casing string 710, and the expander tool 400 simultaneously translates axially along the casing string 710, for example, by movement of the nut member along the threads. FIG. 13 shows the expander tool 400 after it has expanded the casing string 710 from an upper end of the lower portion 795 to a lower end of the lower portion 795.

Figure 14:
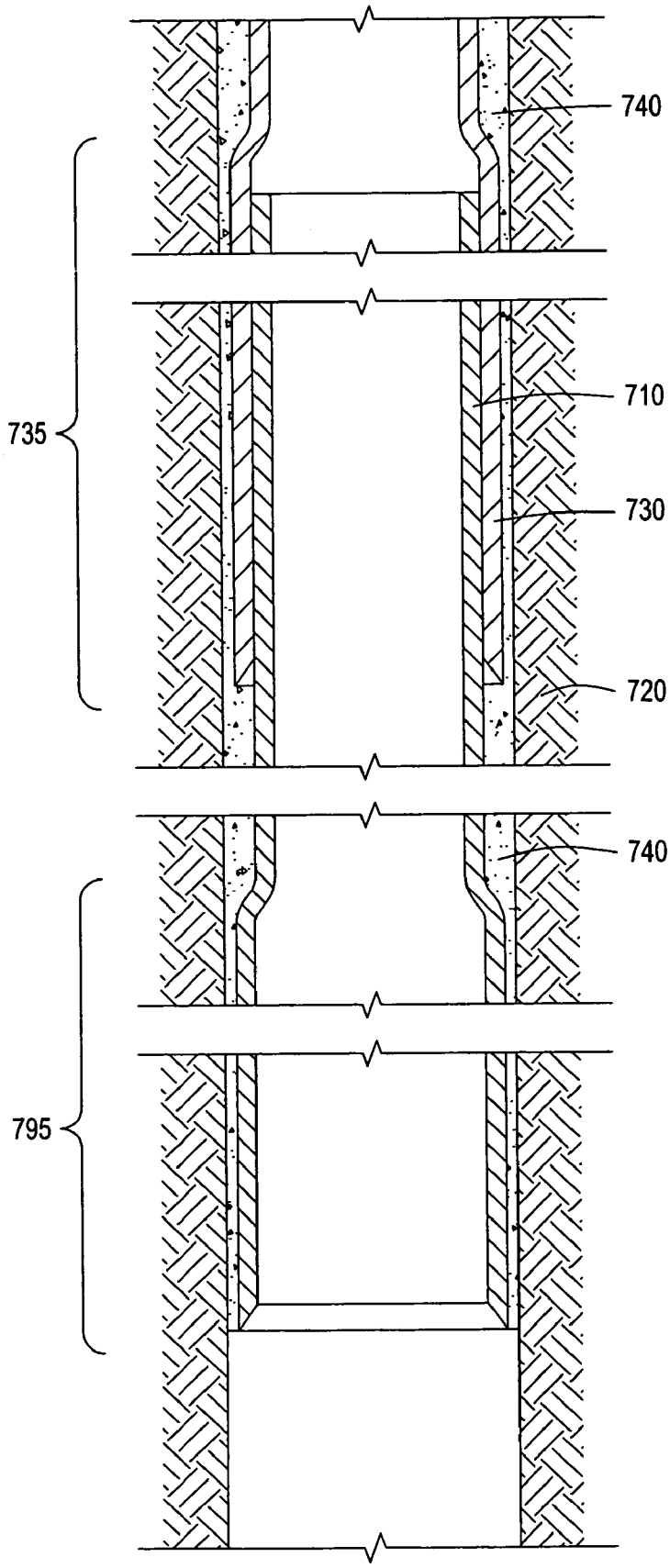
FIG. 14 is a cross-sectional view of the reformed and expanded casing string cemented into the wellbore.

The expander tool 400 is then unactuated when the flow of hydraulic fluid is stopped so that the rollers 464 retract into the windows 262. The retracted expander tool 400 is removed from the wellbore 715. Cement 740 is introduced into the casing 730 and casing string 710 and flows into the annular space between the inner diameter of the wellbore 715 and an outer diameter of the casing string 710. The casing string 710 is shown in FIG. 14 after reformation and subsequent expansion of the lower portion 795, as well as after setting the casing string 710 within the wellbore 715 by curing of the cement 740. At this point, the lower portion 795 of the casing string 710 is ready to receive additional deformed casing strings (not shown), which can be reformed and expanded in the same way as described above.

FIGS. 15–16 illustrate an alternate embodiment of the present invention in the run-in configuration. In this embodiment, the system 100, which was previously described, is threadedly connected at a lower end to an upper end of a cone expander 500, as shown in FIG. 15. A lower end of the cone expander 500 is threadedly connected to the piston housing 722 of the expander tool 200. The remainder of the expander tool 200 is located below the piston housing 722, as depicted in FIG. 6, with the collet fingers 752, 792 retracted.

The cone expander 500 includes a cone 505, a collet assembly 510, and a lower plug end 515 such as a bull plug. The collet assembly 510 of the cone expander 500 is not retractable and extendable to run through the restriction of the casing string 730, so expansion of the inner diameter of the casing string 710 past the inner diameter of the casing string 730 may be accomplished by the expander tool 400 or the expander tool 200.

In operation, the casing string 710 is run into the wellbore 715 so that an upper portion of the casing string 710 is positioned to overlap the expanded inner diameter lower portion of the casing 730, as shown in FIG. 15. As described above in relation to FIGS. 6–14, the working string (not shown) is raised to close the circulating slide valve 110. Hydraulic pressure is introduced into the system 100 to force out movable buttons on the hydraulic hold down 125, as described above. Fluid pressure is maintained at about 1000 p.s.i. so that fluid behind the upper piston 723 moves the collet expander 770 downward with respect to the lower piston 80, forcing the collet fingers 752, 792 over the collet expander 770 and thus outward toward the wellbore 715. Hydraulic pressure on the underside of the piston 131 pulls the expander cone 500 into the lower end of the corrugated casing string 710.

The circulating valve 110 is then opened by lowering the working string and telescoping the circulating valve 110. The working string is raised again to pull up the dual cylinders of the setting tool 745 in relation to pistons 131 held down by the expander cone 500. The remaining portions of the casing string 710 are then reformed by stroking the system 100 in the same manner.

The expander cone 500 reforms the casing string 710 to the shape shown in FIG. 12. As shown in FIG. 16, the inner diameter of the casing string 710 is at least as large as the restriction in the wellbore 715, here at least as large as the inner diameter of the casing 730. However, because the expander cone 500 must run through the restriction of the casing 730, it cannot uniformly expand the diameter of the casing string 710 past its elastic limit.

To further expand the casing string 710 past its elastic limit, the expander tool 200 is employed. Increased pressure, e.g., to 3500 p.s.i. to 5000 p.s.i., pulls the collet assembly 750 through the casing string 710 as fluid behind the piston 131 in the setting tool 745 (see FIGS. 15–16) pulls the expanded collet assembly 750 through the casing string 710 to expand the casing string 710, so that the lower portion 795 of the casing string 710 has an enlarged inner diameter in relation to a remaining portion of the casing string 710 which has merely been reformed and not expanded. The collet fingers 752, 792 are expanded to an extent over the collet expander 770 to be capable of expanding the casing string 710 past its elastic limit. The system 100 is re-stroked as described above to reform and expand the length of the casing string 710. The collet fingers 752, 792 are retracted after the desired portion 795 of the casing string 710 has been expanded past its elastic limit, so that the only expander cone 500 operates to reform the remainder of the casing string 710. FIG. 16 shows the expander cone 500 reforming and the expander tool 200 expanding a lower portion of the casing string 710.

While the expander tool 200 is described in the embodiment of FIGS. 15–16, it is also contemplated that the expander tool 400 of FIG. 13 may be utilized with the expander cone 500. In that embodiment, the upper end of the working string 410 of the expander tool 400 is threadedly connected to the lower end of the expander cone 500. The extendable rollers 464 and the axial movement of the expander tool 400 allow compliant expansion of the diameter of the casing string 710 past its elastic limit. Any other expander tool which is extendable and retractable may be utilized with the present invention to expand the casing string 10 after reformation in one run-in with the expander cone 500, or in two run-ins with any other expander tool.

The above description of the process of reformation and subsequent expansion is described in relation to overlapping portions of casing strings. The above process allows the additional expansion of the lower portion of each casing string to form a monobore well. Ordinarily, an expandable tubular may only be expanded to an inner diameter which is 22–25% larger than its original inner diameter when an expandable tubular is expanded past its elastic limit. The reforming process allows expansion without using up this limit of expansion of the tubular past its elastic limit, so that the lower portion may be expanded up to 25% larger than the original inner diameter before deformation. Advantageously, reforming the casing string may allow an increase in the inner diameter of the casing string of up to about 50% without tapping the 25% limit on the elastic deformation of the tubular. The subsequent expansion process then allows expansion of the tubular the additional 25%. In this way, the inner diameter of the tubular may be expanded up to about 75–80% of its original inner diameter, rather than the mere 25% expansion which was previously possible.

In FIGS. 6–16 above, the inner diameter of the casing 730 provides a restriction in the inner diameter of the wellbore 715. The reformation and expansion process is also useful in expanding the length of a casing string which must run through any other type of restriction in a wellbore, for example, a previously installed casing patch or a packer. Running the casing string into the wellbore in a corrugated shape allows the casing string to possess a small enough outer diameter to fit within the restricted inner diameter of the wellbore produced by the packer or other restriction. Reforming and subsequently expanding allows further expansion of the casing string than was previously possible because the reformation process does not use up the 25% limit on expansion past the elastic limit, as described above. In this way, the reformation and expansion process reduces the annulus between the wellbore and the casing so that a substantially monobore well may be formed despite the restriction in wellbore inner diameter.

An example of a restriction which the reformation and expansion methods described above may run through is a casing patch. A casing patch is typically used to patch holes in previously set casing strings within the wellbore. A casing section is run into the wellbore and expanded into the portion of the casing possessing the unwanted leak paths.

When a casing patch has previously been used to patch a portion of the casing string set within the wellbore, the inner diameter of the wellbore is decreased by the thickness of the casing patch in that portion of the wellbore. A problem results when a leak ensues below the previously installed casing patch. To run a subsequent casing patch into the wellbore to patch the holes below the first casing patch, the subsequent casing patch must have a small enough inner diameter to clear the first casing patch. Current methods of reforming a casing patch after running the patch through the restriction are inadequate for the same reasons discussed above, namely due to problems involving maintaining the structural integrity of the casing patch after deformation.

In using the present invention to reform and expand a casing patch, the casing patch is run into the wellbore in a deformed state, as shown in FIGS. 8–9. An expansion device may be releasably connected to the casing patch upon run-in. Any one of the expansion devices of FIGS. 6–16 may be used to expand the casing patch. The casing patch with the expansion device is run through the restricted inner diameter portion of the wellbore produced by the previously set casing patch and to the depth at which the leak in the casing set within the wellbore exists. The casing patch is reformed, then expanded to contact the casing in the wellbore and substantially seal the fluid path within the casing. The reformation and expansion process is advantageous because it allows expansion of the casing patch through a restriction in wellbore inner diameter to over 22–25% of its original inner diameter while still maintaining the structural integrity of the casing patch.

Figure 17:
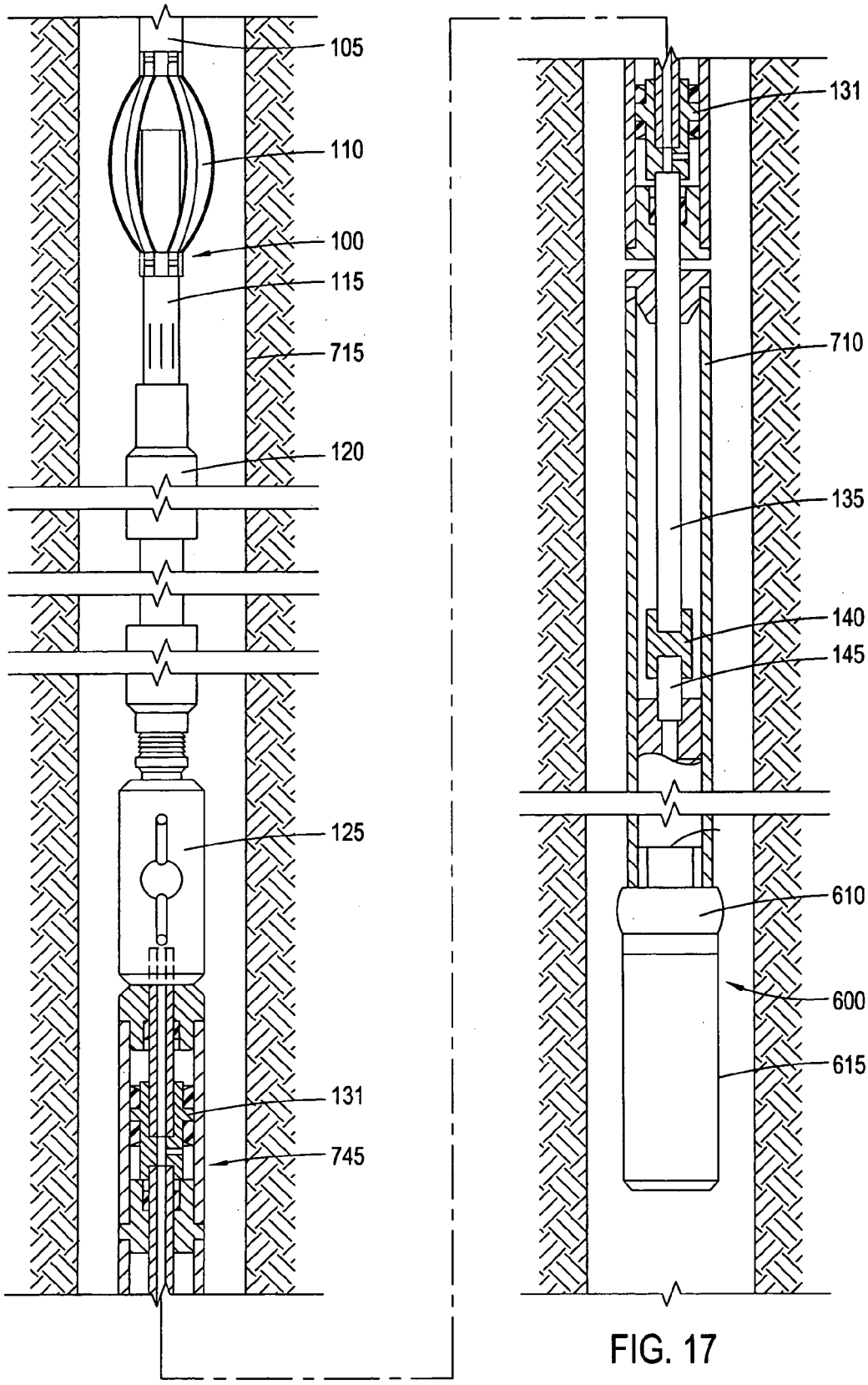
FIG. 17 is a cross-sectional view of an expander tool with a deformed casing string attached thereto within a wellbore in the run-in position.
Figure 18:
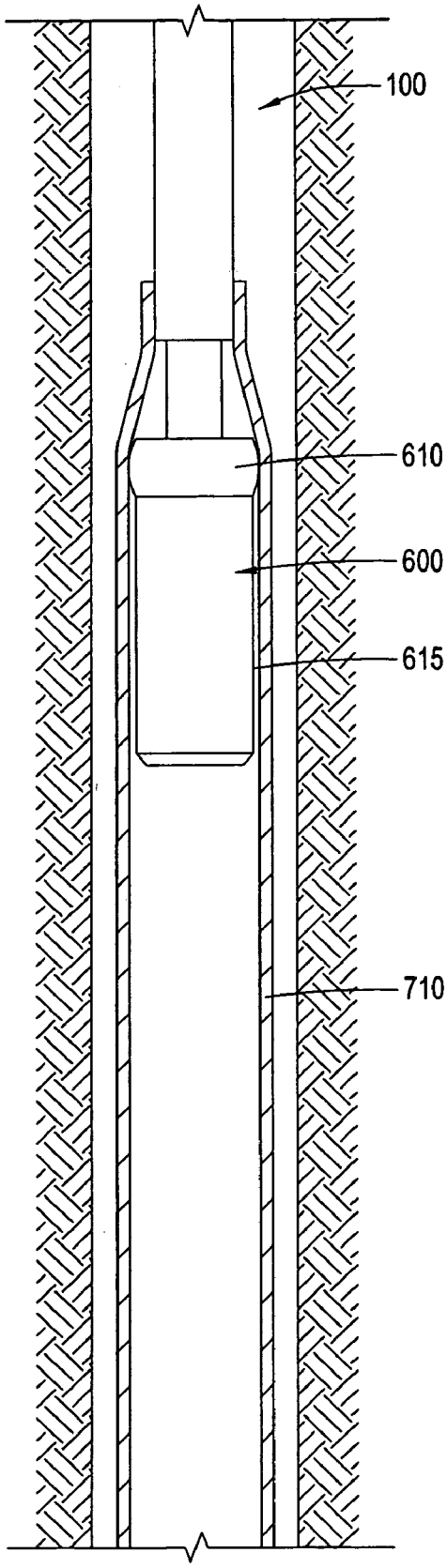
FIG. 18 is a cross-sectional view of the expander tool of FIG. 17 reforming and expanding the casing string past its elastic limit.

FIGS. 17–18 show a further alternate embodiment of the present invention. In FIGS. 17–18, like parts to FIGS. 6–16 are labeled with like numbers. Specifically, the same setting tool 100 with the same components operates in the same fashion to pull an expander tool 600 through the casing string 710.

Referring now to FIG. 17, a lower end of the setting tool 100 is threadedly connected to an upper end of the expander tool 600. The expander tool 600 coupled with the setting tool 100 is especially useful when a restricted area through which the casing string 710 must be run does not exist within the wellbore 715, as the expander tool 600 may be utilized to reform a corrugated casing string 710 and expand the casing string 710 after reformation in the same run-in of the expander tool 600/setting tool 100/casing string 710. Disposed around its upper end, the expander tool 600 has a collet assembly 610 with collet fingers (not shown) made of a flexible material. The collet fingers are disposed around the expander tool 600 with gaps between the collet fingers to allow flexibility during expansion. The expander tool 600 may still substantially uniformly expand the inner diameter of a tubular body, as the gaps between the collet fingers are not large enough to cause indentions in the tubular body. The collet assembly 610 abuts a lower end of the casing string 710 initially. The expander tool 600 also has a lower plug end 615 such as a bull plug.

In operation, the corrugated casing string 710, such as one of the shape shown in FIG. 8, is run into the wellbore 715 in a deformed state with a lower portion of the setting tool 100 disposed therein and the expander tool 600 threadedly connected to the lower end of the setting tool 100. Also, the upper end of the casing string 710 abuts the upper end of the expander tool 600 during run-in. The casing string 710 is run into the wellbore 715 to the desired depth at which to set the casing string 710. FIG. 17 shows the casing string 710 after it has been run into the wellbore 715 with the above-described components on a working string (not shown) from the surface.

The working string is raised to close the circulating slide valve 115. Pressurized fluid is introduced into the working string, which forces out movable buttons on the hydraulic hold down 125, anchoring the setting tool 100 at the desired location within the wellbore 715 and isolating the working string from tensile loads of the setting operation. Hydraulic pressure on the underside of the pistons 131 forces the expander tool 600 into the bottom of the casing string 710 and upward through the casing string 710, as the collet assembly 610 reforms the corrugated casing string 710 into essentially a tubular shape and then expands the outer diameter of the casing string 710 past its elastic limit. The collet fingers possess limited flexibility to expand the casing string 710 in a compliant manner. The expander tool 600 forces the outer diameter of the casing string 710 into the inner diameter of the wellbore 715.

The circulating valve 115 is then telescoped open by lowering the working string. The working string is raised to pull up the dual cylinders of the setting tool 100 in relation to the pistons 131. At this point, the casing string 710 is anchored within the wellbore 715 by friction caused by compressive hoop stress. Again, the circulating valve 115 is closed, and hydraulic fluid is introduced into the setting tool 100. Hydraulic hold down 125 buttons expand again to anchor the cylinder in a new, higher position. The expander tool 600 is then forced through the casing string 710 to expand another portion of the casing string 710 into the wellbore 715. This process is repeated until the length of the casing string 710 is expanded into the wellbore 715.

FIG. 18 shows the expander tool 600 reforming the corrugated casing string 710, then expanding the casing string 710 past its elastic limit, along the length of the casing string 710. The use of the expander tool 600 is advantageous to reform and expand the casing string 710 in one run-in of the expander tool 600 and the casing string 710. It is also contemplated that the casing string 710 may be reformed and expanded upon one run-in by the expander tool 200 of FIG. 6. Reforming and also expanding the casing string 710 past its elastic limit advantageously allows expansion of the casing string 710 by more than the 22–25% currently permitted by mere expansion and also strengthens the casing string 710 to prevent leaks and structural defects in the casing string 710 often encountered by mere reformation of a corrugated casing string.

The expansion process conducted after the reformation process, which is accomplished by all of the above embodiments, serves to increase the strength of the casing string. As such, the expansion process and apparatus above may be used to reform and expand a casing string at any location within a wellbore to strengthen the casing string. A reformed casing string retains stress lines where previously crinkled, which results in a weaker casing string in these areas. The stress lines in the casing string may result in vulnerability to pressure within the wellbore, increasing the possibility of a leak within the casing string. The expansion process after reformation of the present invention adds strength to the casing string, as the stress lines are reduced and possibly erased by the expansion of the tubular past its elastic limit. The stress is redistributed along the casing string by the expansion.

The above embodiments have been described in relation to reforming and expanding by use of expander tools. It is understood that a physical expander tool is not necessary for the present invention; rather, the casing strings 710 and 730 may be reformed and/or expanded past their elastic limit by use of internal pressure within the casing strings 710 and 730. The internal pressure may be adjusted to produce a given amount of expansion or deformation by increasing or decreasing the pressure exerted against the inner diameter of the casing strings 710 and 730.

Figure 19:
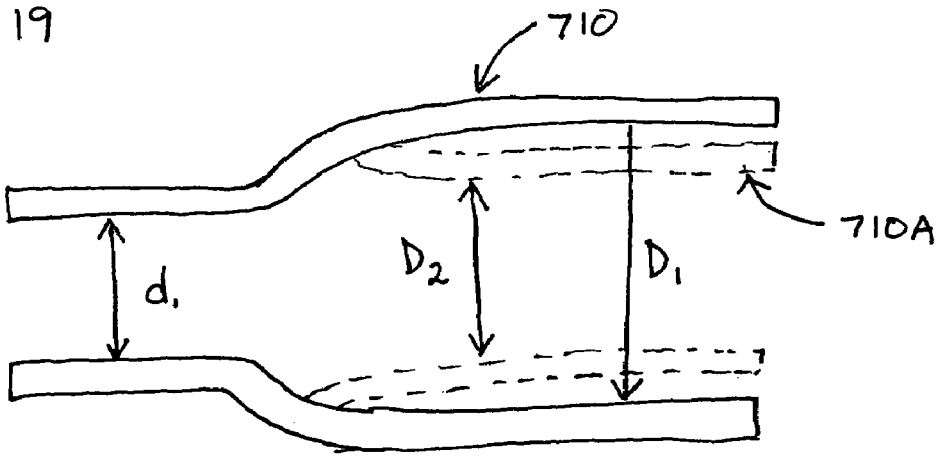
FIG. 19 is a sectional view of the casing string of FIGS. 1–19, showing the casing string partially expanded.

When using an expander tool such as the cone expander which may be used in FIGS. 1–5 or the expander tools depicted in FIGS. 6–7, 10, 13, and 15–18, the casing string 710 and/or 730 of FIGS. 6–18 or the tubing sections 12 or tubing string 32 of FIGS. 1–5 is expanded from a first diameter $d_1$ to a second, larger diameter $D_1$, as shown in FIG. 19. FIG. 19 shows the casing string 710, but it is understood that the same principles described below in relation to FIGS. 19–21 apply equally with respect to the casing string 730 and the tubing sections 12. Also shown in FIG. 19 is the casing string 710 after its potential elastic recovery following expansion, labeled as the elastically recovered casing string 710A. The elastically recovered diameter $D_2$ is the diameter of the elastically recovered casing string 710A.

Figure 20:
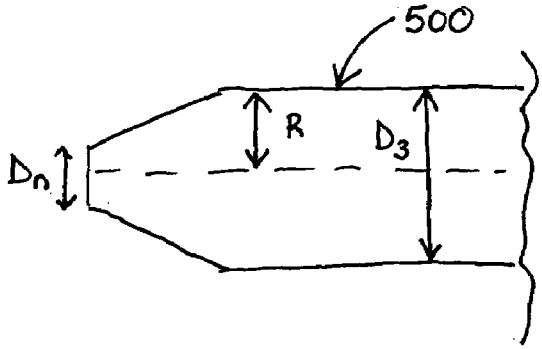
FIG. 20 is a sectional view of an expander tool used to expand the casing string of FIG. 19.

FIG. 20 shows the expander cone 500 of FIGS. 15–16, but it is understood that the expander cone 500 of FIG. 20 also represents any of the expander tools of FIGS. 1–18 having at least one cone portion formed by an expander cone wall which slopes radially inward from a larger, maximum diameter portion $D_3$ to a smaller, nose portion diameter Dn, as shown in FIG. 20. FIG. 20 depicts R, which represents the radius of curvature of the cone between the radius of the cone at a maximum diameter portion $D_3$ (at the release or trailing surface, or at the last cone portion that the casing string 710 contacts) and the expansion surface of the expander cone 500.

Figure 21:
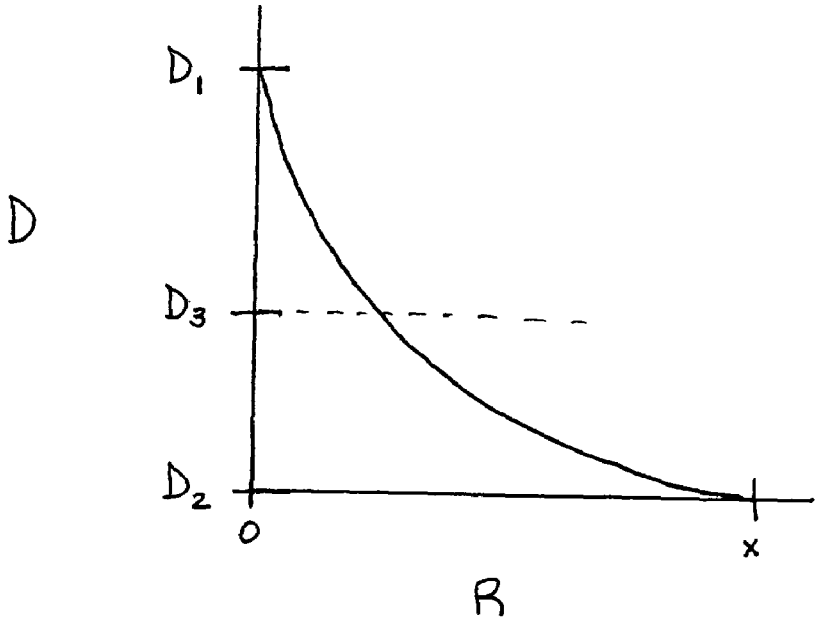
FIG. 21 is a graph of diameters of the casing string of FIG. 19 and of the expander tool of FIG. 20 versus the radius of curvature between the expansion surface and the release surface of the expander tool of FIG. 20.

FIG. 21 graphically illustrates an approximate relationship between the diameters $D_1$, $D_2$, and $D_3$ and the radius of curvature R. As shown in FIGS. 19–20, diameters $D_3$, $D_2$, and $D_1$ are not equal; rather, diameter $D_2$ is less than diameter $D_3$, and diameter $D_3$ is less than diameter $D_1$. The elastically recovered casing string 710A thus has a smaller diameter $D_2$ than the maximum diameter $D_3$ of the expander cone 500, which results in difficulty removing the expander cone 500 from the casing string 710A. It is usually more desirable to obtain the diameter $D_1$ of the casing string 710 so that the expander cone 500 is more easily removed following expansion and the casing string 710 is expanded to its maximum potential. The relationship between the diameters $D_1$, $D_2$, and $D_3$ and the radius of curvature R may be utilized to determine the radius of curvature R which is necessary to limit the elastic recovery of the casing string 710A to allow for the maximum expansion of the casing string 710 as well as to allow for facilitated removal of the expander cone 500 from the casing string 710 following expansion. At the very least, it is desirable to choose a radius of curvature R of the expander cone 500 which will create an expanded casing string diameter greater than diameter $D_3$ so that the expander cone 500 may be removed from the casing string 710.

The following formula is an approximate characterization of the relationship between the radius of curvature R of the expander cone 500 and the diameters $D_3$ and $d_1$:

$$R \cong y \times (D_3 - d_1),$$

where R is the radius of curvature of the expander cone 500, $D_3$ is the maximum diameter of the expander cone 500, and $d_1$ is the initial, unexpanded diameter of the casing string 710. The factor y preferably ranges from approximately 0.3 to 0.7, in the range which is physically possible and practically acheivable. Specifically, $d_1$ is maximum when R is equal to 0, but it is physically impossible for R to equal 0. Preferably, y ranges from 0.4 to 0.5, and even more preferably y is 0.5. The above equation results in the diameter D being equal to the desired maximum diameter $D_1$ of the casing string 710 shown in FIG. 19.

The radius of curvature R between the expansion surface of the cone 500 and the radius at $D_3$ affects the difference between the diameter $d_1$ of the unexpanded casing string 710 and the diameter $D_2$ or $D_1$ (or a diameter in between these diameters) which the casing string 710 will become. An abrupt slope of the expander cone 500 produces the desired resulting casing string 710 diameter $D_1$.

While the foregoing is directed to embodiments of the present invention, other and further embodiments of the invention may be devised without departing from the basic scope thereof, and the scope thereof is determined by the claims that follow.

The invention claimed is:

1. A method of forming a substantially monobore well, comprising:

running a deformed first casing string into a wellbore;

reforming the first casing string;

expanding a lower portion of the first casing string past its elastic limit;

running a second deformed casing string into the wellbore to a depth at which the lower portion of the first casing string overlaps a portion of the second casing string; and reforming the second casing string.

2. The method of claim 1, further comprising expanding a lower portion of the second casing string past its elastic limit.

3. The method of claim 1, wherein an inner diameter of the second casing string is at least as large as an inner diameter of a portion of the first casing string which is not expanded past its elastic limit.

4. The method of claim 1, wherein a compliant expander tool expands the lower portion of the first casing string.

5. The method of claim 4, wherein the compliant expander tool comprises mismatched collet fingers expandable by movement over a cone.

6. The method of claim 1, wherein a non-compliant expander tool expands the lower portion of the first casing string.

7. A method of expanding at least a portion of a tubular body into a wellbore, comprising:

running a deformed tubular body into a wellbore through a restricted inner diameter portion of the wellbore;

locating at least part of the deformed tubular body below the restricted inner diameter portion within an enlarged inner diameter portion of the wellbore that is relatively larger in diameter than the restricted inner diameter portion;

reforming the tubular body; and expanding at least the portion of the tubular body past its elastic limit.

8. The method of claim 7, wherein the restricted inner diameter portion comprises casing.

9. The method of claim 7, wherein the inner diameter of the tubular body after reforming the tubular body is at least as large as the restricted inner diameter portion of the wellbore.

10. The method of claim 7, wherein reforming the tubular body comprises increasing an outer diameter of the tubular body.

11. The method of claim 7, further comprising deforming the tubular body by forming grooves within the tubular body prior to running the deformed tubular body into the wellbore.

12. The method of claim 7, wherein expanding at least the portion of the tubular body increases the inner diameter of the at least the portion of the tubular body.

13. A method of expanding at least a portion of a tubular body into a wellbore, comprising:

running a deformed tubular body into a wellbore through a restricted inner diameter portion of the wellbore, wherein the restricted inner diameter portion comprises a casing patch;

locating the deformed tubular body below the restricted inner diameter portion;

reforming the tubular body; and expanding at least the portion of the tubular body past its elastic limit.

14. A method of expanding a tubular body into a wellbore, comprising:

providing a first assembly comprising:

a deformed first tubular body, a first expander tool disposed within the first tubular body, and a second expander tool with extendable members connected to the first expander tool;

running the first assembly into a wellbore;

reforming the first tubular body to a first inner diameter with the first expander tool; and expanding at least a portion of the first tubular body to a second, larger inner diameter with the second expander tool.

15. The method of claim 14, wherein the first expander tool comprises an expander cone.

16. The method of claim 14, wherein the second expander tool comprises a body with extendable members therein, wherein the members are extendable in response to hydraulic pressure.

17. The method of claim 14, wherein the second expander tool comprises a body having mismatched collet fingers extendable by movement along a cone.

18. The method of claim 17, wherein the collet fingers comprise a flexible material.

19. The method of claim 14, wherein the reforming and expanding is accomplished without removing the first assembly from the wellbore.

20. The method of claim 14, wherein the second expander tool is connected below the first expander tool.

21. The method of claim 14, wherein the at least the portion of the tubular body is the lower portion.

22. The method of claim 21, further comprising:

removing the first expander tool and the second expander tool from the wellbore;

providing a second assembly comprising:

a deformed second tubular body, the first expander tool disposed within the second tubular body, and the second expander tool connected to the first expander tool;

placing an upper portion of the second tubular body adjacent to the lower portion of the first tubular body;

reforming the second tubular body to a first inner diameter with the first expander tool; and expanding at least a portion of the second tubular body to a second, larger inner diameter with the second expander tool.

23. An apparatus for forming a cased wellbore, comprising:

a deformed, expandable casing string;

a first expander tool; and a second expander tool having extendable members therein connected to the first expander tool, wherein the expander tools and the casing string are arranged such that the expander tools are disposed within the casing string when run in hole.

24. The apparatus of claim 23, wherein the second expander tool comprises mismatched, opposing flexible members expandable by moving along a cone, wherein the opposing flexible members move along the cone to engage one another.

25. The apparatus of claim 23, wherein the second expander tool comprises a body with extendable members therein, wherein the members are extendable in response to hydraulic pressure.

26. The apparatus of claim 23, wherein the extendable members of the second expander tool are mechanically actuated to expand the casing string past its elastic limit.

27. The apparatus of claim 23, wherein the first expander tool comprises an expander cone.

28. A method of expanding at least a portion of a tubular body into a wellbore, comprising:

running a deformed tubular body into the wellbore;

reforming the tubular body; and expanding at least the portion of the reformed tubular body using a compliant expander, wherein a radius of curvature between an expansion surface of the compliant expander and a release surface of the compliant expander is selected to reduce elastic recovery of the tubular body after expansion.

29. The method of claim 28, wherein the radius of curvature between the expansion surface of the compliant expander and the release surface of the compliant expander is selected according to the relationship between a maximum diameter of the compliant expander and an inner diameter of the tubular body prior to expansion.

30. The method of claim 29, wherein the radius of curvature between the expansion surface of the compliant expander and the release surface of the compliant expander equals a factor multiplied by the difference between the maximum diameter of the compliant expansion tool and the inner diameter of the tubular body prior to expansion, wherein the factor ranges from 0.3 and 0.7.

31. The method of claim 30, wherein the factor is 0.5.

32. The method of claim 28, wherein a radius of curvature between the expansion surface of the compliant expander and the release surface of the compliant expander is selected to expand the tubular body to an inner diameter which is larger than a diameter of the release surface of the compliant expander.

33. A method for placing an expanded tubular into a wellbore comprising:

providing an assembly comprising a deformed tubular body having an undeformed substantially circular diameter and at least one major axis as deformed that is less than the undeformed diameter and an expander member;

lowering the assembly into the wellbore;

positioning the assembly at a desired location in the wellbore;

reforming the tubular body so that at least one of the major axis is substantially the same as the undeformed diameter;

expanding the tubular body past its elastic limit using the expander member; and allowing elastic recovery of the tubular body, the tubular body having a diameter larger than the undeformed diameter following the recovery.

34. The method of claim 33, wherein the deformed tubular body is corrugated.

35. The method of claim 33, wherein the reforming is at least in part performed using fluid pressure.

36. The method of claim 33, wherein the expander member comprises at least one radially extendable member.

37. The method of claim 33, wherein the positioning places the deformed tubular body in at least partially overlapping relationship with a wellbore tubular.

38. The method of claim 33, wherein the positioning places the deformed tubular body entirely in unlined wellbore.

39. The method of claim 33, wherein the assembly further comprises a second expander member.

40. The method of claim 39, wherein the reforming is at least in part performed using the second expander member.

41. The method of claim 39, wherein the second expander member comprises a cone.

* * * * *